United States Patent [19]

Morez et al.

[11] 4,148,241

[45] Apr. 10, 1979

[54] ELECTRONIC MUSICAL INSTRUMENT WITH MEANS FOR AUTOMATICALLY GENERATING CHORDS AND HARMONY

[75] Inventors: Gene S. Morez, Morton Grove; Richard S. Swain, Des Plaines, both of Ill.

[73] Assignee: Norlin Music, Inc., Lincolnwood, Ill.

[21] Appl. No.: 607,900

[22] Filed: Aug. 26, 1975

[51] Int. Cl.[2] ..... G10F 1/00; G10H 1/02

[52] U.S. Cl. ..... 84/1.03; 84/1.24; 84/DIG. 12; 84/DIG. 22

[58] Field of Search ..... 84/1.01, 1.03, 1.17, 84/1.24, DIG. 22, DIG. 12

[56] References Cited

U.S. PATENT DOCUMENTS

| | | | |
|---|---|---|---|
| 3,548,066 | 12/1970 | Freeman | 84/1.03 |
| 3,743,755 | 7/1973 | Watson | 84/1.01 |
| 3,789,718 | 2/1974 | Bunger | 84/1.01 |
| 3,929,051 | 12/1975 | Moore | 84/1.17 |
| 4,019,417 | 4/1977 | Carlson | 84/1.17 |

*Primary Examiner*—Edith S. Jackmon

*Attorney, Agent, or Firm*—Hill, Gross, Simpson, Van Santen, Steadman, Chiara & Simpson

[57] ABSTRACT

An electronic musical instrument incorporates a single integrated circuit chip for performing a variety of logical operations for the production of chords and various accompaniment signals automatically, in response to depression of one or two keys within a related portion of the keyboard of the instrument. A multiplexer is employed, in association with the keyboard, to produce a train of signals in response to depression of one or more keys, and one or more function control switches; certain ones of these signals are used to address a plurality of read only memory devices for the generation of the several components needed for the mode of operation which is selected. In an automatic chord mode, a chord is selected automatically, corresponding to an operated key of the keyboard. The chord components include the root, the third (which may be selectively minored), the fifth, the sixth and the seventh (which can be selected or not). The several chord components are mixed in a stair step network for one output signal, and may selectively be produced individually for an arpeggio or a strum or both.

57 Claims, 16 Drawing Figures

| | | |
|---|---|---|
| FIG. 4a | FIG. 4b | FIG. 4c |
| FIG. 4d | FIG. 4e | FIG. 4f |

100
105
CL
CL
÷4
102
104
106
494
492
490
A=B
COMP
148
D
L's
S
150
144
C
L's
S
146
156
164
162
1 OF 12
DECODE
158
160
1 OF 12
DECODE
164a
164l
44
166
ROOT
CONTROL
ROM
ROOT
PFS
168
170
172
45
THIRD
CONTROL
ROM
MIN.
ENABLE
3RD
PFS
196
198
174
178
180
182
184
186
188
160a
160l
156e
156f
156g
272
DIVIDE
CONTROL
LOGIC
50a
270
ROOT
DIVIDER
UNIT
274
51a
THIRD
DIVIDER
UNIT
277
278
496

E
164
D
G#
G
F#
F
E
D#
270
÷2
÷2
÷2
277a
÷2
277b
277d
÷2
277c
180
277e
184
G
F#
156g
156f

ELECTRONIC MUSICAL INSTRUMENT WITH MEANS FOR AUTOMATICALLY GENERATING CHORDS AND HARMONY

BACKGROUND

1. Field of the Invention

The present invention relates to electronic musical instruments, and more particularly to electronic organs having apparatus for automatically producing chords and harmony and a variety of bass patterns for accompanying a melody played on the instrument.

2. The Prior Art

Several attempts have been made to produce organs which generate automatically chords and harmony and bass patterns, to accompany a melody played on the instrument. While many of these work well for the purposes intended, they are either relatively limited in their performance, or relatively complicated and expensive, requiring a large number of parts.

Accordingly, there is a need for an improved circuit which employs fewer parts than heretofore used, but which is able to perform all of the desired functions in a simple and economical manner.

BRIEF DESCRIPTION OF THE INVENTION

It is a principal object of the present invention to provide a control circuit for an electronic musical instrument whereby a number of control functions may be carried out by integrated circuitry incorporated in a single integrated circuit package.

Another object of the present invention is to provide an integrated circuit package for performing a variety of control functions in association with an electronic musical instrument, in which such package incorporates a number of read only memories, each associated with a frequency synthesizer unit, so that the frequency synthesizer unit produces a rectangular wave signal having a pulse repetition rate uniquely associated with each individual address of the read only memory.

Another object of the present invention is to provide an integrated circuit package for an electronic musical instrument incorporating a plurality of read only memories and a plurality of frequency synthesizers, each associated with one of the read only memories, so that each of the read only memories may be programmed differently so as to uniquely produce a signal having a pulse repetition rate related to an individual component of a musical chord.

Another object of the present invention is to provide such an integrated circuit in which the data used for addressing all of said read only memories is derived from a stream of pulses resulting from multiplexing a plurality of switches, some of which are operated in response to depression of keys of the keyboard of the musical instrument.

These and other objects and advantages of the present invention will become manifest by an inspection of the accompanying drawings and the following description.

In one embodiment of the present invention there is provided an integrated circuit formed of a single chip of semiconducting material, incorporating multiplexing means for producing a train of pulses in response to operation of a plurality of switches, some of which are operated in response to depression of keys of the keyboard of a musical instrument, a plurality of read only memories responsive to addresses derived from said train of pulses and each being operative to produce a unique signal having a pulse repetition rate corresponding to an individual element of a chord associated with a depressed key, a plurality of frequency dividers connected to receive the signals produced by said read only memories, a logic network for controlling the operation of said divider chains to produce output signals having a controlled pitch, and control means for controlling the timing at which the output signals are produced.

BRIEF DESCRIPTION OF THE DRAWINGS

Reference will now be made to the accompanying drawings, in which:

FIG. 4, comprising FIGS. 4*a* through 4*f*, constitutes a schematic block diagram in more complete detail of a portion of the apparatus of FIG. 1;

DESCRIPTION OF THE PREFERRED EMBODIMENT

General

Figure 1:
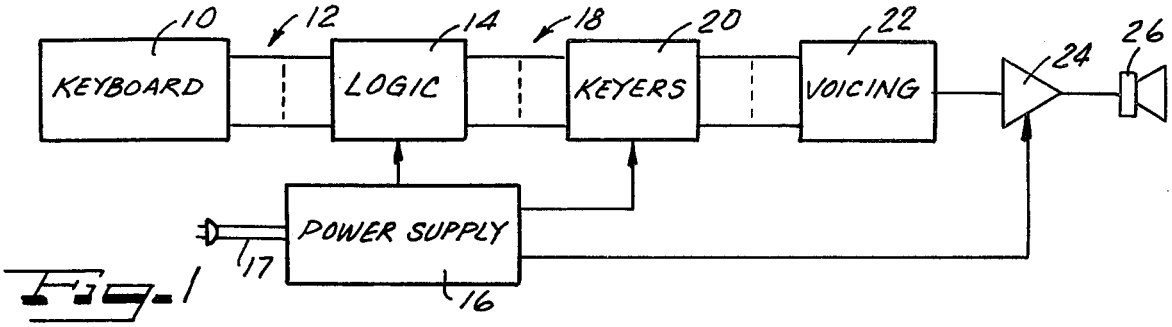
FIG. 1 is a functional block diagram of an electronic musical instrument incorporating an illustrative embodiment of the present invention.

Referring first to FIG. 1, the musical instrument of the present invention incorporates a keyboard 10 which is connected by a number of lines 12 with a logic unit 14. A power supply 16 provided with a line chord 17 is provided to supply electrical power to the logic unit 14, and it processes information received from the keyboard and from a plurality of auxiliary switches (not shown ) and produces a plurality of outputs on a number of output lines 18. The output lines 18 are connected to inputs of a plurality of keyers 20, which also receive power from the power supply 16, and the outputs of the keyers 20 are passed through one or more voicing units within a voicing section 22; the output of the voicing section 22 is amplified by an amplifier 24 and is supplied to a loudspeaker 26. The amplifier 24 is also supplied with power from the power supply 16.

Not shown in FIG. 1 is a plurality of auxiliary function control switches, such as the normal switches or tablets usually associated with electronic organ keyboards. A variety of such switches are provided and function in the normal way to control the amplifier 24 and the voicing section 22, as well as the keyers 20. They also control the logic unit 14, in ways which are described hereinafter. Of the units in FIG. 1, only the logic unit 14 is not conventional. All of the other units correspond to known apparatus available in the art, and any of a number of different constructions may be employed.

Figure 2:
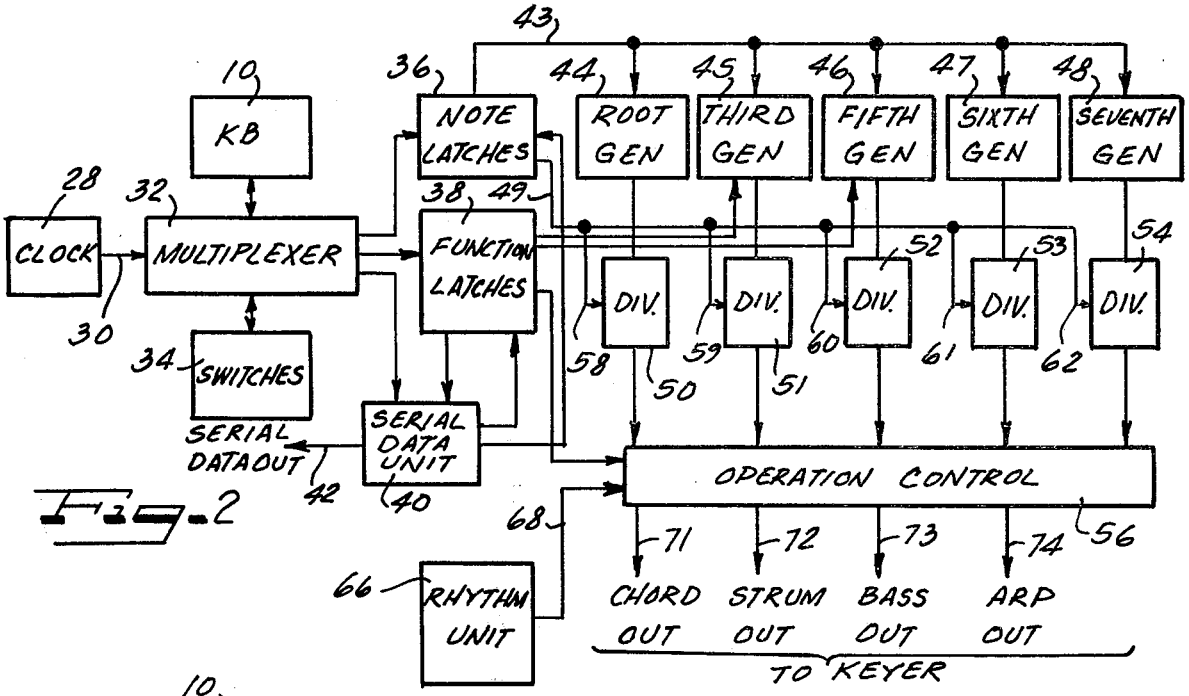
FIG. 2 is a functional block diagram in more detail of a portion of the apparatus illustrated in FIG. 1.

In FIG. 2, a general block diagram of the logic unit 14 and its associated structure is illustrated.

A clock signal generator 28 is provided for producing a series of clock pulses on a line 30, for regulating operation of the logic unit. The line 30 is connected to the input of a multiplexer 32, which is connected to a number of different functional units. In addition to the keyboard 10, the multiplexer 32 is connected to a plurality of function control switches 34, a plurality of note latches 36, a plurality of function latches 38, and a serial data unit 40. The function of the multiplexer 32 is to examine the state of the keys of the keyboard 10 and the various switches of the functional switches 34, and to produce signals for controlling the latches 36 and 38 so that the latches are set in accordance with the depressed keys of the keyboard and the operated function control switches.

The serial data unit 40 is responsive to the multiplexer 32 an also to the function latches 38 for producing on an output line 42 a pulse train including a pulse for at least one of the operated keys of the keyboard 10, as well as some additional pulses which are inserted under control of the serial data unit 40. The pulses on the line 42 are passed to other apparatus (not shown) and employed to produce musical sounds corresponding, in frequency, to the time position of each of the pulses in the train.

The note latches 36 provide an output on the line 43 which is applied to a plurality of generators 44–48. The generator 44 produces signals corresponding in frequency to that of the root of a given chord, a generator 45 produces signals corresponding to the musical third of the chord, and the generators 46–48 produce signals having frequencies corresponding to the musical fifth, sixth and seventh of the chord.

The generators 44–48 each produce an output which is connected to an individual divider unit of a set of such units 50–54. The outputs of the divider units 50–54 are all connected to inputs of an operation control unit 56, and the operation control unit 56 in turn controls operation of the divider units 50–54 by means of signals on lines illustrated in FIG. 2 by lines 58–62.

The operation control unit 56 also receives signals from the rhythm unit 66 over a line 68. A number of outputs are produced by the control unit 56, as follows. A line 71 produces a chord output corresponding to a chord produced by operation of the control unit 56. A plurality of lines illustrated by the line 72 in FIG. 2 produces a number of signals in time succession for producing a strummed effect in either a high or low pitch. A plurality of lines indicated by the line 73 in FIG. 2 produce signals which are used for providing bass accompaniment, and the plurality of lines signified by the line 74 in FIG. 2 produce a plurality of signals useable in connection with an arpeggio operation.

The apparatus illustrated in FIG. 2 is capable of operation in two different modes, which are described in more detail hereinafter in connection with FIG. 4. It is useful, however, to summarize the features of the two modes of operation here, in connection with the more generalized diagram of FIG. 2.

The first mode of operation will be referred to as the high-low mode. When this mode of operation is selected, two of the keys of the keyboard are effective to select two tones which are produced in the output. The two keys which are effective are the highest and lowest keys operated within a given area of the keyboard; that is, the rightwardmost and the leftwardmost ones of all of the operated keys within that area, if more than two are operated. The designated area comprises the lowest twenty-eight keys of the keyboard 10. The two tones which are produced in response to operation of these two keys are produced at separate outputs simultaneously, but may be made to sound alternately under control of pulses from the rhythm unit 66.

The second mode of operation is the automatic chord mode, in which only a single key of another given portion of the keyboard (vis., the lowest twelve keys) is effective to control the operation control unit. That signal key is the uppermost (or rightmost) one of the operated keys (of the lowest twelve keys) if more than one are operated, and the position of this key designates a particular chord name, such as an A chord, a C chord, etc. The tone corresponding to the root of this chord, as well as the tones for the third and fifth, are simultaneously passed to the output and made available at the chord output 71. An operator may selectively decide to minor the third, producing a minor chord instead of a major chord, and the operator may also decide to selectively add the seventh to the cord, producing chord, dominant seventh chord, major or minor.

The chord selected by means of a single key, in the automatic chord mode, is outputed continuously and may also be outputed in one or both of two discontinuous patters, hereinafter referred to as the strum signal output and the arpeggio signal output. When the strum signal output is selected, signals from the rhythm generator supplied to the operation control unit 56, cause the production of the several tones of the chord to be sounded, one at a time, in upward progression, just as if the strings of a stringed musical instrument were being strummed by a player. When the arpeggio signal output is selected, tones representing the root, third and fifth of the selected chord, in three separate octaves, are generated by the logic unit 56, and are sounded in ascending and then descending fashion, continuously. Both the strum and the arpeggio signal outputs begin with the sounding of the root tone. The strum signal outputs may be selected to occur in either of two octave ranges, a high or low octave, under the control of one of the function switches 34.

Bass signals produced on the line 73 may consist of a variety of different bass patterns. One pattern is alternately sounding tones corresponding to the highest and lowest ones of a plurality of keys which are operated in a designated portion of the keyboard, just as in the high-low mode, described above. In another pattern, the root and fifth of a particular chord are alternately sounded in the bass. In yet a third pattern, a walking bass is produced, in which tones corresponding to the root, third, fifth, sixth and seventh of the selected chord are produced in succession, in time with pulses received from the rhythm unit 66, ascending and descending.

A latch operation may be selected, by operation of one of the function controlling switches 34, which causes the operation of the operation control unit 56 to persist, even after the depressed keys of the keyboard have been released. When the latch mode is not selected, the output signals produced by the operation control unit 56 terminate when the depressed keys are released.

Reference will now be made to FIG. 4, for a more complete description of logic unit 14 and its associated apparatus. FIG. 4 is made up of six sections, viz., FIGS. 4*a*–4*f*, assembled as illustrated in FIG. 5.

Clock Pulses

Figures 4A, 5:
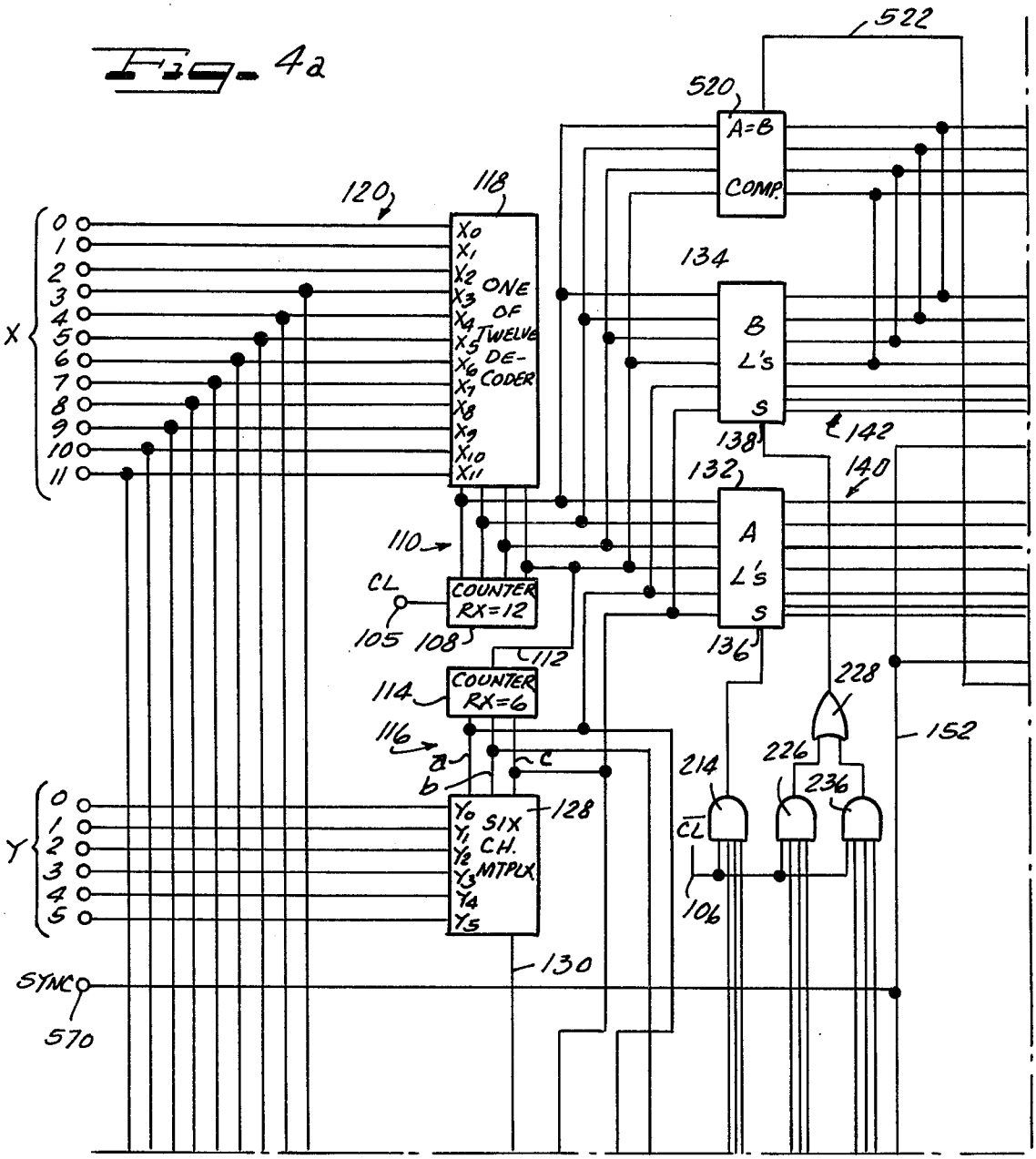
FIG. 5 is an illustration of how
FIGS. 4*a*–4*f* are interconnected.
Figure 4B:
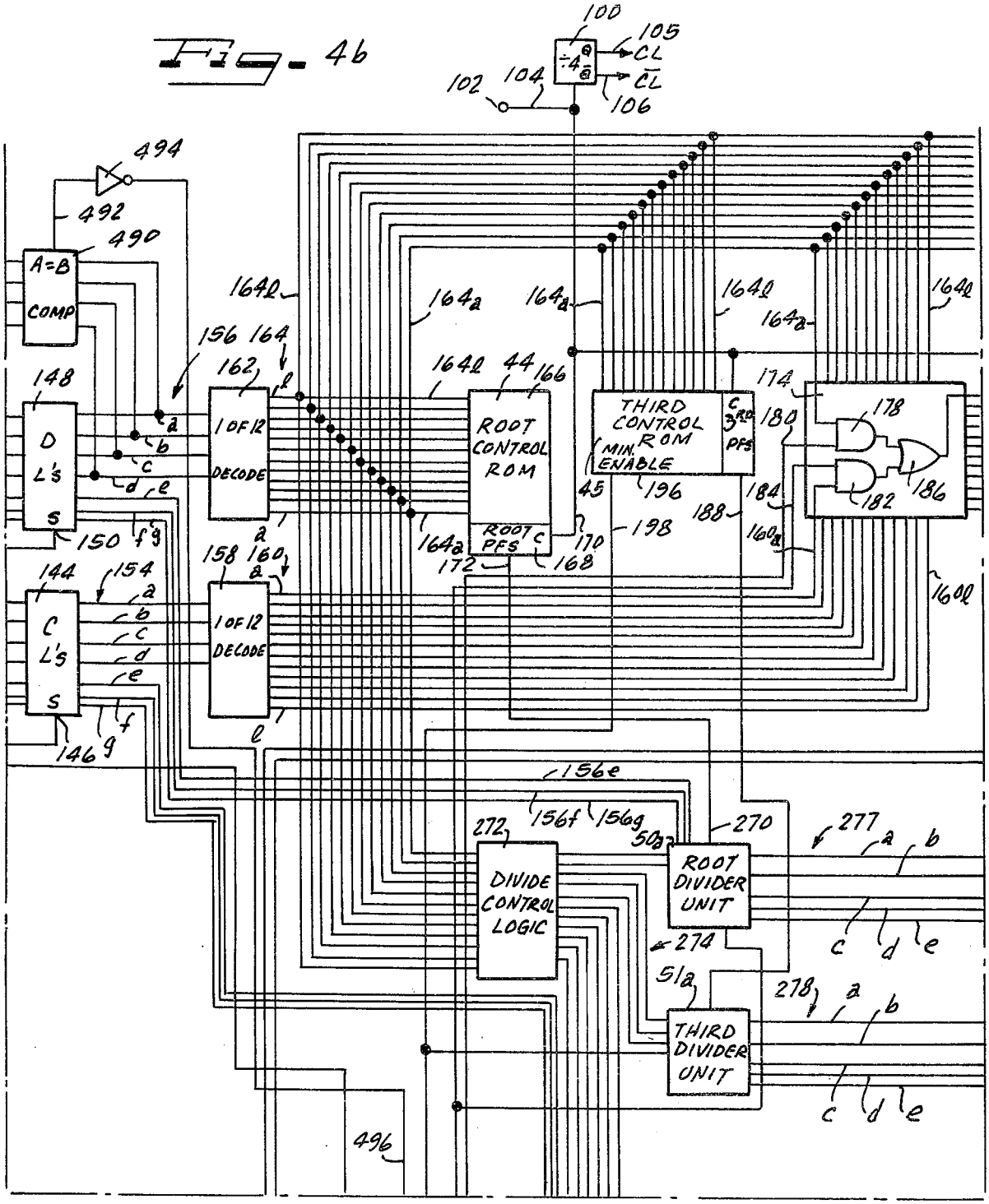
Figure 4C:
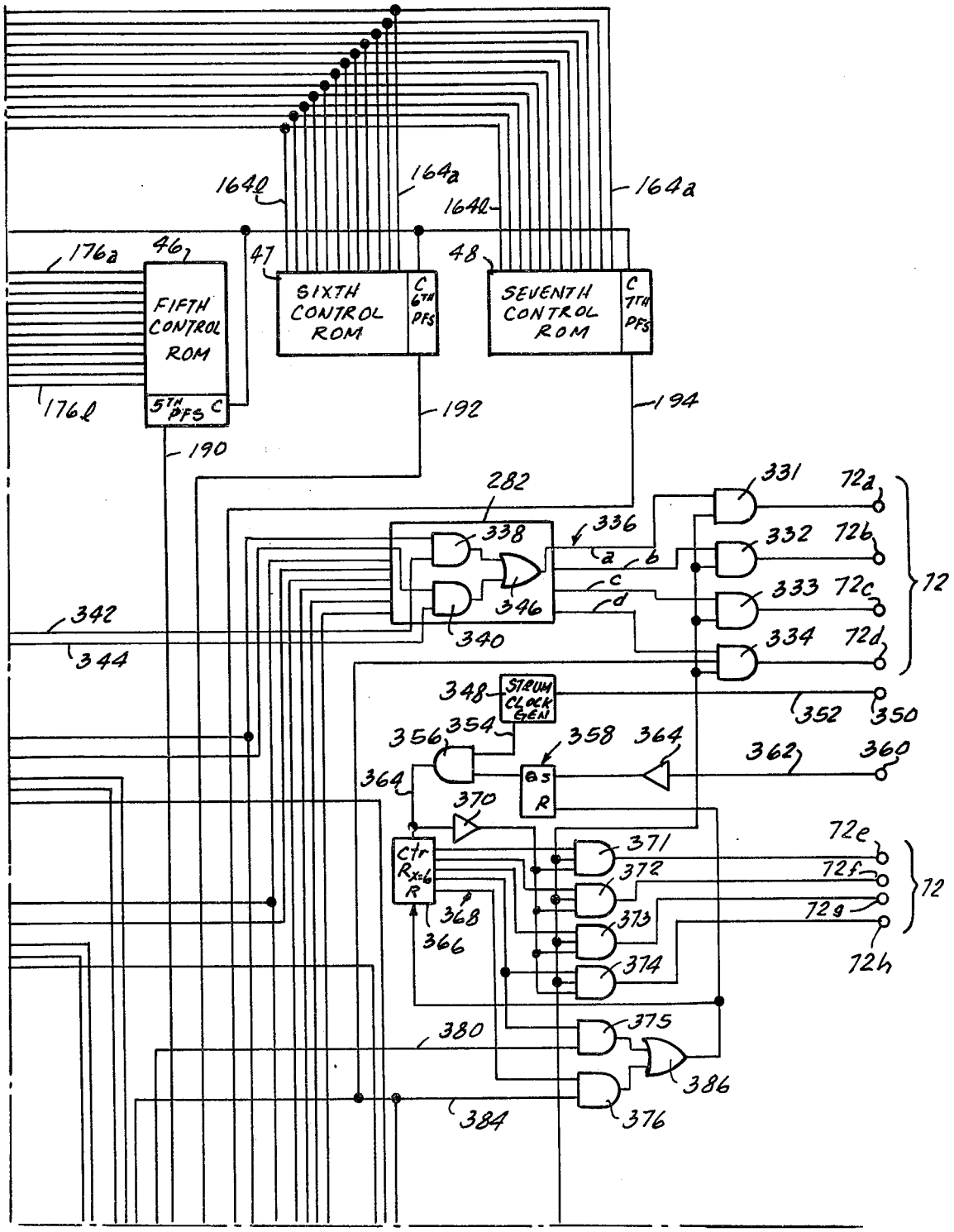
Figure 4D:
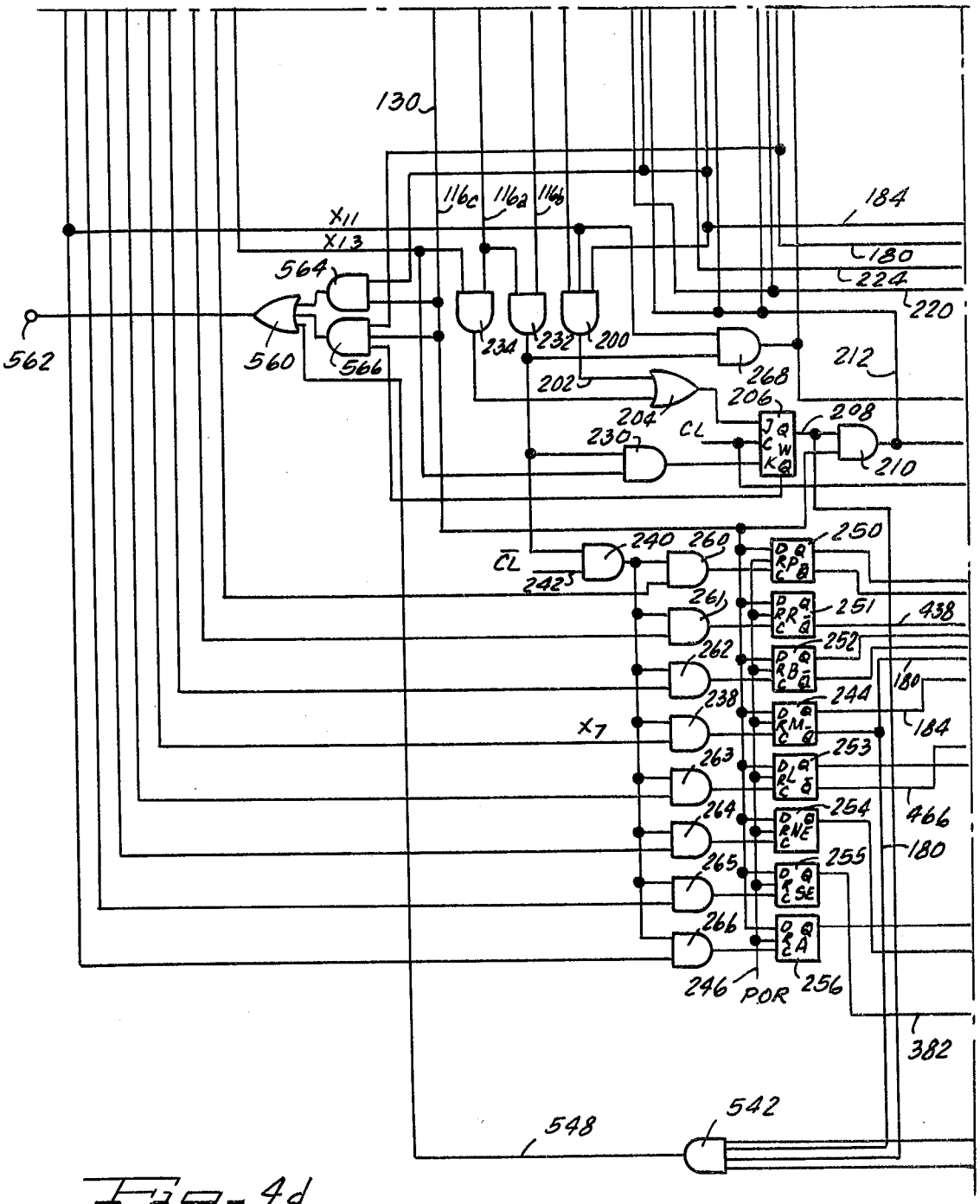

Clock pulses are generated by a divider 100, illustrated in FIG. 4*b*. A terminal 102 is connected to an external source of high speed clock pulses, and a line 104 connect the terminal 102 to the input of the divider 100. The divider 100 produces on two lines 105 and 106 normal and inverted clock pulses, which are distributed throughout the remainder of the system where they are needed. The high speed clock pulses applied to the terminal 102 are used in connection with the frequency synthesizers, as described hereinafter.

Multiplexer, Keyboard and Function Switches

The line 105 is connected to the input of a counter 108 (FIG. 4a), which forms a part of the multiplexer 32 (FIG. 2). The counter 108 is a binary counter having four stages connected so as to have a radix of twelve. That is, the counter 108 has twelve different states, which are repeated in endless succession as input pulses are received from the line 105.

Four output lines are connected individually to the four stages of the counter, and signals on the output lines 110 represent the current state of the counter 108, in binary representation. The counter 108 counts consecutively from zero through eleven, and the next clock pulse received resets the counter 108 to zero, whereupon the operation is repeated. Overflow pulses are produced on an output line 112 each time the counter 108 is reset to zero, and the line 112 is connected to the input of a counter 114.

The counter 114 is a three-stage binary counter, connected to have a radix of six, and a plurality of lines 116 are connected individually to its three stages. The state of the counter 114 is incremented by one for each complete cycle of the counter 108, so that the signals on the output lines 110 and 116 form a cyclically repeating pattern for every seventy-two clock pulses. Seventy-two clock pulses constitute a single cycle of operation of the multiplexer, during which the status of seventy-two switches is sensed, to derive information relative to operation of the instrument.

The output lines 110 of the counter 108 are connected to four input lines of a one-of-twelve decoder 118, which functions to decode the binary representation of the signals on the output lines 110 and energize one of twelve output lines 120, in accordance with the state of the counter 108. The twelve output lines 120 are designated in FIG. 4a as the "X" outputs and are numbered zero through eleven, to indicate the state of the counter 108 when each respective X line is energized.

Figure 3:
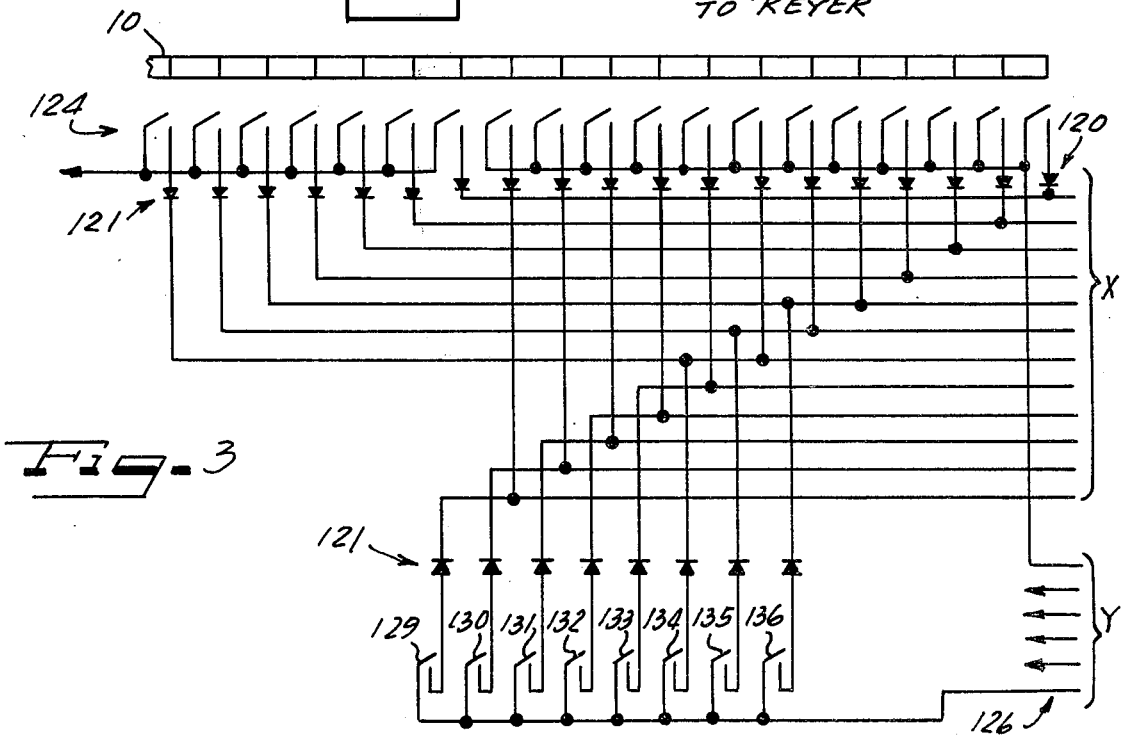
FIG. 3 is a schematic diagram of a portion of a keyboard and a plurality of function control switches associated with the logic unit of FIG. 1.

The X lines 120 are connected to the keyboard switches and the function switches, through diodes 121, as illustrated in FIG. 3. The keyboard 10 is represented schematically, and under each key of the keyboard 10 there is a keyboard switch 124 which is actuated when its corresponding key is depressed. Each of the switches 124 is a normally open, single-pole, single-throw switch. One terminal of the switch is connected to one of the X lines 120, and the switches 124 which are associated with corresponding keys of the keyboard 10 in different octaves are connected to the same X line 120. Thus, the common poles of all of the A keys are connected together, through diodes 121, to one of the X lines 120, the common poles of all of the B-flat keys 124 are connected in common to a second of the X lines, etc.

The other pole of each of the switches 120 is connected to one of several Y lines 126. The Y lines 126 are connected to the switches 124 in accordance with their octave location relative to the keyboard. Thus, the first of the Y lines 120 is connected in common to the second terminal of the first twelve switches 124 (for the highest octave), the next Y line is connected in common to the next twelve switches 124, etc. A total of sixty-four keys are provided in the keyboard 10, and there are sixty-four switches 124 connected in the manner partially illustrated in FIG. 3. The last of the Y lines 126 is connected to four switches 124 of the lower left-hand end of the keyboard 10 (not shown), and to eight function control switches 129 through 136. The Y line is connected to the second pole of the switches 129 through 136, with the first terminal of the switches 129 through 136 connected to the last eight of the X lines 120.

In operation, one of the X lines is energized with a signal in the manner described above, in accordance with the state of the counter 108. This signal is then applied to all of the switches associated with keys for the same note name and, in some cases, to one of the function control switches 128–136. Each of these switches 124 which is closed completes a path from the energized X line to one of the Y lines 126. The Y line which is energized by any closed switch depends upon the position of that switch in the keyboard. A switch in the highest octave will energize the first Y line, a switch in the second highest octave will energize the second Y line, etc. If the energized X line is connected to a closed function control switch, the last of the Y lines is energized. For any given combination of X and Y lines there is one and only one switch which can complete a path, and this one switch may be either a keyboard switch 124 or a function control switch 129–136.

The Y lines 126 are connected to six inputs of a six-channel multiplexer 128 (FIG. 4a). The multiplexer 128 receives its control inputs from the output lines 116 of the counter 114, and functions to connect one and only one of the Y lines 126 to an output 130 of the multiplexer 128, in accordance with the state of the counter 114. The output line 130 thus contains, for each cycle of operation of the multiplexer 32, a train of pulses, including one pulse for each of the operated switches 124 and 129–136. The pulses are encoded in time position representative of the switches which are operated. Hereinafter the seventy-two pulse times of each cycle will be referred to as pulse time 1 through pulse time 72. Pulses occurring during the first sixty-four pulse times represent operated keys of the keyboard, while the last eight pulse times represent operated ones of the function switches.

Note Latches

The identification of the note corresponding to a pulse within the first sixty-four pulse times corresponds to the binary coded output on the lines 110 at the timme of occurrence of such pulse on the line 130. Similarly, the octave of such note (the octave of the keyboard in which its associated key is located) is identified by the binary code on the output lines 116. Thus, the simultaneous condition of the outputs 110 and 116 uniquely represents the specific switch which is being scanned at any instant. These seven lines, viz., the four lines 110 and the three lines 116, are connected to seven inputs of a group of A latches 132 and to seven inputs of a group of B latches 134. The A latches 132 are provided with a set input 136, and, when the set input is energized with a set pulse, the latches 132 are set in accordance with the signals then present on the lines 110 and 116. That is, a high level on one of the lines 110 and 116 at the set pulse time causes its respective latch to be set in one state, and a low level then causes it to be reset to the opposite state. A similar set terminal 138 is provided for the B latches. The set inputs 136 and 138 are energized with set pulses at specific times, as described more fully hereinafter.

Seven output lines 140 connected to the A latches continuously manifest voltage levels representative of the states of the individual latches 132. Similarly, seven output ines 142 manifest the states of the B latches 134. The lines 140 are connected to seven inputs of a group of C latches 144, which is provided with a set input 136. When the set input 136 is energized, the C latches 144 are set in accordance with the signals on the lines 140. Similarly, the lines 142 are connected to seven inputs of a group of D latches 148, which has a set input terminal 150. When the set input terminal 150 is energized, the D latches 148 are set in accordance with the signals on the lines 142. The set input terminals 146 and 150 are energized with set pulses together by signals on a line 152, derived in a manner described more fully hereinafter.

When the C and D latches are set, outputs on lines 154 and 156 manifest the states of these latches. The four lines 154, which carry signals derived initially from the outputs of the counter 108, are connected to four inputs of a one-of-twelve decoder 158, which functions to energize one of twelve output lines 160, in accordance with the binary representation of the signals on the lines 154. Similarly, the four of the lines 156, which also manifest information originally derived from the counter 108, are connected to four inputs of a one-of-twelve decoder 162, which manifests an output on one of its twelve output lines 164, in accordance with the binary representation of its four inputs lines.

Tone Signal Generators

The signals on the lines 110, produced by the counter 108, represent in binary form the note name of the key connected at that moment to the energized one of the X lines 120. Accordingly, the one of the twelve lines 164 which is energized at any given time corresponds to the note name of the operated key, the representation of which is stored in the D latchs 148. Similarly, the energized one of the lines 160 corresponds to the note name of the operated key, the representation of which is stored in the C latches. The times of setting of the C and D latches are described hereinafter.

The twelve lines 164 are connected to twelve inputs of a root tone signal generator 44, which is made up of a read only memory or ROM 166 and a programmable frequency synthesizer 168. The ROM is a read only memory having twelve storage locations, which are addressed, respectively, individually, by the twelve input lines 164. Addressing any one of the twelve storage locations causes the read only memory to supply a divisor control signal to the PFS 168, which controls the effective division rate of the PFS. The PFS 168 receives as a dividend signal input a high speed clock from the terminal 102, over the lines 104 and 170. It produces an output signal on a line 172, which output signal corresponds to a quotient of the high speed clock frequency, in accordance with the divisor signal supplied by the ROM 166. This output signal has a pulse repetition rate corresponding to the note name of a key of the keyboard 10. Assuming that depression of an A key resulted in setting the D latches 148, the signals on the lines 156 correspond to the note "A," and the one output line 164 of the decoder 162 corresponds to the note name "A". This line addresses the "A" storage location of the ROM 166, which controls the PFS 168 so that the high frequency clock signal on the line 170 is divided by an appropriate divisor so as to produce on the line 172 a continuous train of pulses having a pulse repetition rate corresponding closely to a harmonic of 440 Hz, which corresponds with the note name "A."

When the D latches 148 are set in response to a different key, a different output line 164 is energized, and a different storage location of the ROM 166 is addressed, producing a different divisor input to the PFS 168 with a correspondingly different pulse repetition rate on the output line 172. Thus, the particular energized one of the output lines 164 causes the root tone signal generator 44 to produce on its output line 172 a continuous pulse train having a pulse repetition rate corresponding to a harmonic of the note of the depressed key.

The output lines 164 are also connected to the twelve inputs of the other four tone signal generators 45–48. The connection of the lines 164 to the fifth tone signal generator 56 is made through a plurality of gates 174. The gating network 174 incorporates twelve sets of gates, one for each of its set of twelve output lines 176. In addition to the twelve lines 164, the twelve lines 160, produced by the decoder 158, are also presented to the gates 174. Only the gates associated with the lines **164*a* and 160*a*** will be described in detail, since all the other gates are identical.

An AND gate 178 has one input connected to the line **164*a* and the other input connected to a control line 180. A second AND gate has one inut connected to the line 160*a* from the decoder 158, and its second input is connected to a control line 184. The control lines 184 and 180, hereinafter referred to as the "M" line and the "$\overline{M}$" line, present complementary signals, so that one and only one of the gates 178 and 182 is conditioned to pass either the signal on the line 164*a* or the signal on the line 160*a*. The outputs of the two AND gates 178 and 182 are each connected to two inputs of an OR gate 186, the output of which is connected to the output line 176*a*. Accordingly, at all times either the lines 164 or the lines 160 are connected to the twelve inputs of the fifth tone signal generator 46, depending upon the condition of the lines 180 and 184**.

Each of the generators 45–48 are provided with an ROM and a PFS, just as described in connection with the generator 44. The address coding of each of the ROM's is different, however, so that the frequency or pulse repetition rate of the tone signals produced by the PFS's of the several generators are different. Assuming that the line **164*a* corresponds to an "A," the pulse repetition rate of the output signal produced by the root generator 44 on the output line 172 is, as described, a harmonic of 440 Hz, corresponding to the note name "A." The third for the chord of A is C♯, and, when the line 164*a* is energized, the output line 188 of the third generator 45 produces a continuous train of pulses having a pulse repetition rate corresponding to C♯. Similarly, the pulse trains produced on the output lines 190, 192 and 194, the fifth, sixth and seventh generators 46–48, correspond to the pulse repetition rates for the notes E, F♯ and G. In each case the address coding of the ROM associated with each generator is such that when the line 164*a* is energized, continuous pulse trains at the pulse repetition rates or frequencies corresponding to various parts of the chord of A are produced. The pulse repetition rate of the signal on the line 194** corresponds to the seventh of the A chord, which is the note normally included in a dominant seventh chord.

Instead of the line **164*a*, if the line 164*b* is energized, a different set of frequencies, corresponding to parts of the chord of B-flat, is produced on the output lines of the generators 45–48. It is therefore apparent that an entire set of frequencies making up a chord is simultaneously produced by the several tone signal generators in response to the setting of the D latches 148**. The manner in which these several frequencies are employed is dependent upon operation of the function switches and the operation control unit, as described hereinafter.

The third tone signal generator 45 is unlike the generators 44 and 46–48 in that its ROM 196 has an additional input line 198. When the line 198 is energized, it operates effectively to cause the ROM 196 to function as if a different one of the input lines 164 were energized. This causes the ROM 196 to supply a different divisor signal to the PFS of the tone signal generator 45, so that a signal having a pulse repetition rate corresponding to a minor third is produced on the output line 188, instead of the major third signal normally produced. Then, when the line 164*a* is energized, to designate the A chord, and the line 198 is also energized, the desired output from the third generator 45 corresponds to C (the minor third of the A chord) instead of C#. C is the major third in the G# chord, represented by the line 1641, and so energization of the minor selection line 198 causes the ROM 196 to operate as if the line 1641 were energized instead of the line 164*a*. A simple gating circuit is effective to accomplish this result, and the specific circuitry employed is, therefore, not discussed in detail. It is identical to the gating circuit 174, using the line 194 to energize one set of gates, and an inverter having its input connected to the line 195 to drive the other set of gates.

Set Pulses for Note Latches

The note latches 132 and 134 require set pulses to be applied to their inputs 136 and 138 so that the latches can be set in accordance with a given note and octave. The generation of the signals applied to these inputs will now be described.

As described above, all of the pulses representative of the operation of the keys of the keyboard 10 occur during the first sixty-four time periods of each cycle of operation. Only pulses which occur during a portion of this group of time periods are used to provide information to the A and B latches 132 and 134. Specifically, in the hi-low mode of operation, only pulses occurring during pulse times 36 through 64 function to operate the A and B latches, while in the automatic chord mode of operation, only pulses occurring between pulse times 52 and 64 are effective for this purpose.

1. Hi-Low Mode

An AND gate 200 (FIG. 4*d*) has three inputs which are connected, respectively, to one of the outputs (viz., 116*b*) of the counter 114 (FIG. 4*a*), the XII line 120, and the line 184 which bears an M signal when the hi-low mode is selected. Therefore, the gate 200 is effective or is operated when the hi-low mode is selected and when there is a coincidence of pulses on the 116*b* line and the XII line. This occurs for the first time at pulse time 36, and thus at pulse time 36 the gate 200 produces a pulse which is passed over a line 202 to one input of an OR gate 204. The output of the OR gate 204 is connected to the J input of a JK flip-flop 206, hereinafter referred to as the W flip-flop.

The W flip-flop, when set, designates a window interval, by producing a high voltage level on its Q output, which is connected by a line 208 to one input of an AND gate 210. The second input of the AND gate 210 is connected to the line 130, which is the serial data output from the multiplexer 128. Accordingly, the output of the gate 210 first occurs in response to the first pulse on the line 130 following setting of the flip-flop 206, and is conveyed over a line 212 to one input of an AND gate 214 (FIG. 4*a*). Two other inputs to the AND gate 214 are derived from the M line 184 and the $\overline{Q}$ output of a JK flip-flop 218 (FIG. 4*e*), which is hereinafter referred to as the FN flip-flop.

At the time of operation of the AND gate 210, the flip-flop 218 is in its reset condition, so that the potential on its $\overline{Q}$ output line 220 is high. The line 220 is connected as an input to the AND gate 214. Thus, the first pulse which passes the AND gate 210, providing the M line is high, is effective to enable the AND gate 214, and the fourth input which is connected by a line 106 functions to operate the AND gate 214 at the next inverted clock pulse time, producing an output which is applied to a set terminal 136 of the A latches 132. In this way the first data pulse appearing on the line 130 is effective to set the A latches, and the condition of the counters 108 and 114 at this time describes the note and octave location of the operated switch of the keyboard responsible for production of the first pulse on the line 130.

The output of the AND gate 210, in addition to supplying a pulse to the AND gate 214, is also connected by a line 222 to the J input of the FN flip-flop 218. The FN flip-flop 218, which was previously in its reset state, is thereby set by such pulse, representative of the first note encountered following pulse time 36, during a scan of the keyboard. Since the $\overline{Q}$ output of the FN flip-flop 218 is connected to one input of the AND gate 214, the AND gate 214 is ineffective to supply any additional pulses after the first pulse is encountered during the scan.

The Q output of the FN flip-flop 218 is supplied by a line 224 to one input of an AND gate 226 (FIG. 4*a*). Another input of the AND gate 226 is supplied with inverted clock pulses over the line 106. The other two inputs of the AND gate 226 are connected to the M line 184, which is high during the hi-low mode, and to the output of the AND gate 210 by way of the line 212. Since the AND gate 210 provides pulses to the lines 212 for each pulse on the line 130 representative of a depressed key, beginning at pulse time 36, a succession of pulses is produced at the output of the AND gate 226, one for each depressed one of the lowest twenty-eight keys of the keyboard. This output is connected through an OR gate 228 to the set terminal 138 of the B latches 134. Accordingly, the B latches 134 are set for each pulse on the line 130, subsequent to the first encountered pulse following pulse time 36, during each scan of the operated keys of the keyboard, and remain set in accordance with the note and octave of the last key-representative pulse encountered during each cycle of operation of the multiplexer. Pulse time 64 identified the last pulse which can be representative of operation of a key of the keyboard, and an AND gate 230 (FIG. 4*d*) produces a pulse which resets the W flip-flop 206 at this time, thereby presenting the AND gate 210 from producing any further outputs for setting the B latches 134.

The two inputs of the AND gate 230 are connected to the X3 line and to the ouput of an AND gate 232. The two inputs of the AND gate 232 are connected to the lines 116*a* and 116*c*, which enable the AND gate 232 only during the period in which a pulse on the X3 line is representative of the pulse time 64. Accordingly, the output of the AND gate 230 is first produced at pulse time 64, so that the W flip-flop 206 is reset at pulse time 64, ending the window period during each cycle of operation during which the A and B latches 132 and 134 may be set.

2. Automatic Chord Mode

During the automatic chord mode operation, identified by a low signal on the M line 184 and a high signal on the $\overline{M}$ line 180, it is desirable to set the B latches in accordance with pulses occurring during the twelve pulse times 53 through 64, representative of keys in the lowermost octave of the keyboard. The A latches are not used at this time.

An AND gate 234 is provided for setting the W flip-flop 236 at pulse time 52. its two inputs are connected to the X3 line and the 116*c* line, so that it first produces an output during a cycle of operation at pulse time 52. This output is passed through the OR gate 204 to the J input of the flip-flop 206, to set it at pulse time 52, during the automatic chord mode. The AND gate 200, which sets the flip-flop 206 during the hi-low mode, is ineffective during the automatic chord mode, since its input connected to the M line 184 is low.

Setting the flip-flop 206 enables the AND gate 210 to pass the data pulses from the line 130 to the line 212, from which they are connected to one input of an AND gate 236. Another input of the AND gate 236 receives inverted clock pulses from the line 106, and the other two inputs of the AND gate 236 are connected to the $\overline{M}$ line 180 and to a line 120 connected to the $\overline{Q}$ output of the FN flip-flop 218. Since the $\overline{M}$ line 180 is high during the automatic chord mode, and the Q output of a flip-flop 218 is high for the first pulse passed by the AND gate 210, the AND gate 236 is operated, and produces a pulse which is passed to the OR gate to the set input of the B latches 134. The flip-flop 218 is set after the first pulse pssed by the AND gate 210, so that subsequent pulses are ineffective to set the B latches 134. Accordingly, the B latches are set in accordance with the first pulse encountered after pulse time 52 in the automatic chord mode.

3. C and D Latches

The D latches 148 are set in accordance with the note information stored in the B latches at the end of each cycle of operation of the multiplexer. The line 152, which is connected to the set input of the D latches 148, is connected to the output of an AND gate 268 (FIG. 4*d*) which produces an output at time 72. its two inputs are connected to the output of the AND gate 232 and to the XII input, which produce coincident signals only at pulse time 72. The C latches 144 are also set, to the condition stored in the A latches 132, at pulse time 72 by the signal over the line 152. Accordingly, the C and D latches continue to manifest output signals corresponding to the keys which are operated during the previous cycle of operation of the multiplexer, while the A and B latches are updated during the current cycle of operation of the multiplexer. The A and C latches affect the operation of the apparatus only in the hi-low mode.

Function Latches

The mode of operation of the apparatus is determined in accordance with the setting of one of the function switches 38; specifically, the function switch which is scanned during pulse time 68. An AND gate 238 is provided for providing a pulse at pulse time 68, and its inputs are connected to the X7 line and the output of an AND gate 240. The AND gate 240 has its two inputs connected to the output of the AND gate 232 and to the inverted clock pulses over a line 242. It produces a high signal at its output only during the last twelve pulse times of a cycle of operation, so that a signal which appears on the X7 line in coincidence with an output of the AND gate 240 identified the pulse time 68.

The output of the AND gate 238 is connected to the clock input of an M flip-flop 244, the Q and $\overline{Q}$ outputs of which are connected to the M line 184 and the $\overline{M}$ line 180, respectively. The M flip-flop 244 is a type D flip-flop, the D input terminal of which is connected to the data line 130. Accordingly, the flip-flop 244 is set when a data pulse on the line 130 corresponds with pulse time 69, and is reset when no data pulse appears at this pulse time. The flip-flop 244 is also reset by a signal on a line 246, connected to its reset or R input. The line 246 receives a signal in response to the power-on reset operation, which provides a resetting pulse for a plurality of flip-flops of the system when power to the apparatus is first turned on.

A plurality of additional D-type flip-flops 250–256 are provided for indicating when other function switches are operated. Each of them has its C input connected to an individual AND gate 260–266, which decodes the pulse time at which a data pulse on the line 130 represents closing the associated function switch. The AND gates 260–266 all have one input connected to the output of the AND gate 240, and a second input connected to lines X4 through X6 and X8 through X11 (FIG. 4*a*). The D inputs of all of the flip-flops 250–256 are connected to the data line coincident with operation of its respective AND gate 260–266. In addition, all have their reset inputs connected to the power-on reset line 256.

The P flip-flop 250 is set or reset in accordance with the desired octave of the strum operation. The R flip-flop 251 is set in response to operation of the rhythm generator 66. When the rhythm generator 66 is operated, so as to select any rhythm pattern, the R flip-flop 251 is set. The switch which is sensed during the pulse time at which the R flip-flop 251 is set is ganged with all of the rhythm selecting switches of the ryhthm unit 66, so that any rhythm is selected, the ganged switch is closed and the R flip-flop 251 is set. The B flip-flop 252 is set when a particular bass pattern is desired, and is otherwise reset. The M flip-flop 244, as already described, is set when a hi-low mode is desired and otherwise represents selection of the automatic chord mode. The L flip-flop 253 is set when the latch function is desired. The NE flip-flop 254 is set when the chord produced by the apparatus is desired to be a minor chord. The SE flip-flop 255 is set when it is desired to add the seventh to the chord produced by the apparatus, and the A flip-flop 256 is set when an arpeggio is desired. The Q outputs of the NE and SE flip-flops are connected to the set inputs of the N and S flip-flops 377 and 378, respectively, so these flip-flops remain set, and latched, even after the NE and SE flip-flops are reset. Thus, the switches for setting NE and SE flip-flops may be momentarily acting switches. The switch for setting the NE flip-flop is preferably located near the operator's foot, so that it can be closed momentarily by a side movement of the operator's foot, while the switch for setting the SE flip-flop is preferably ganged with the lowest keyboard key which is not a chord-selecting key, so that the S and SE flip-flops are set by a momentary depression of this key.

The manner in which each of these flip-flops control operation of the operation control unit 56 will become clear in connection with the following description of the logic unit 56.

Divider Units

Figure 4E:
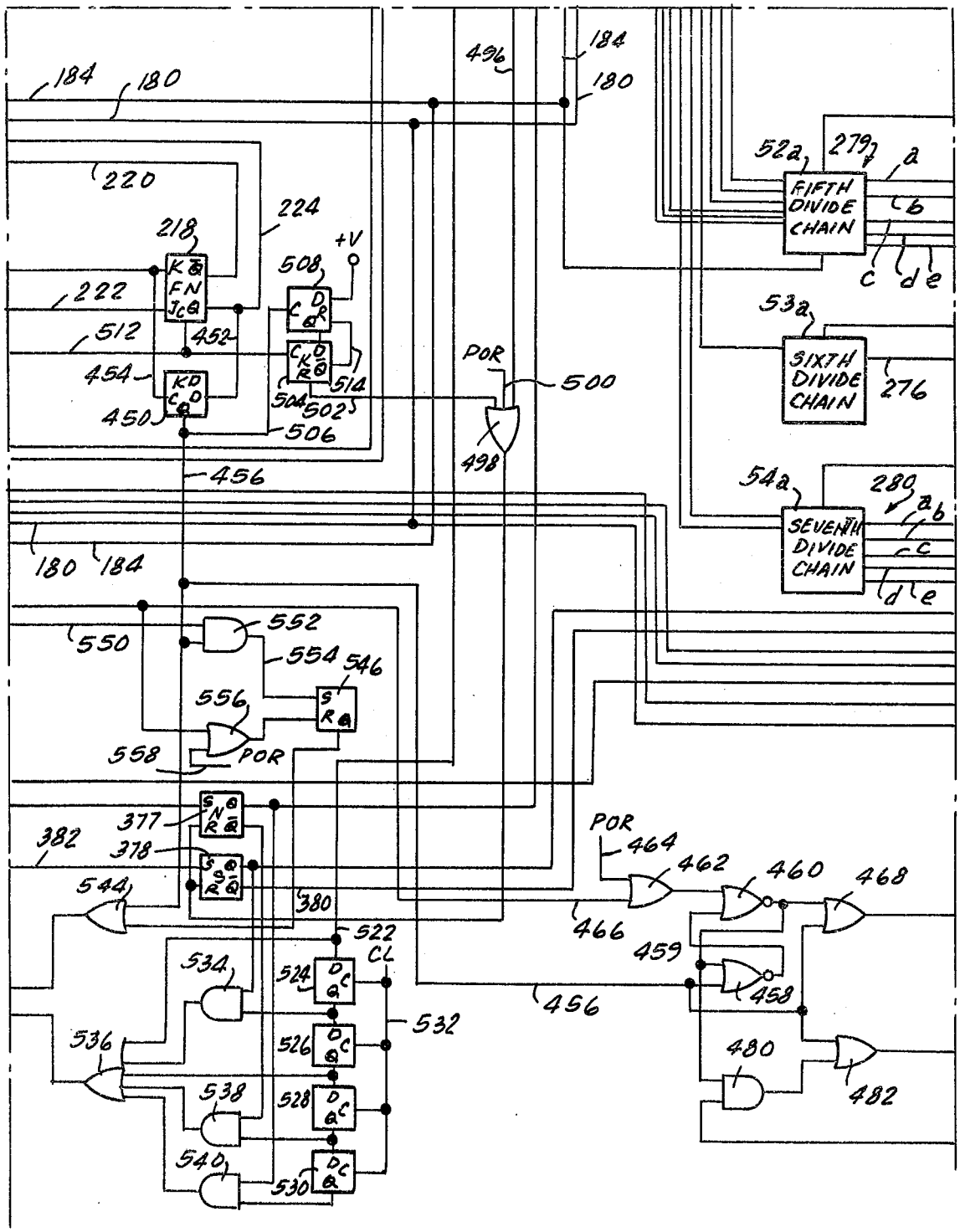
Figure 4F:
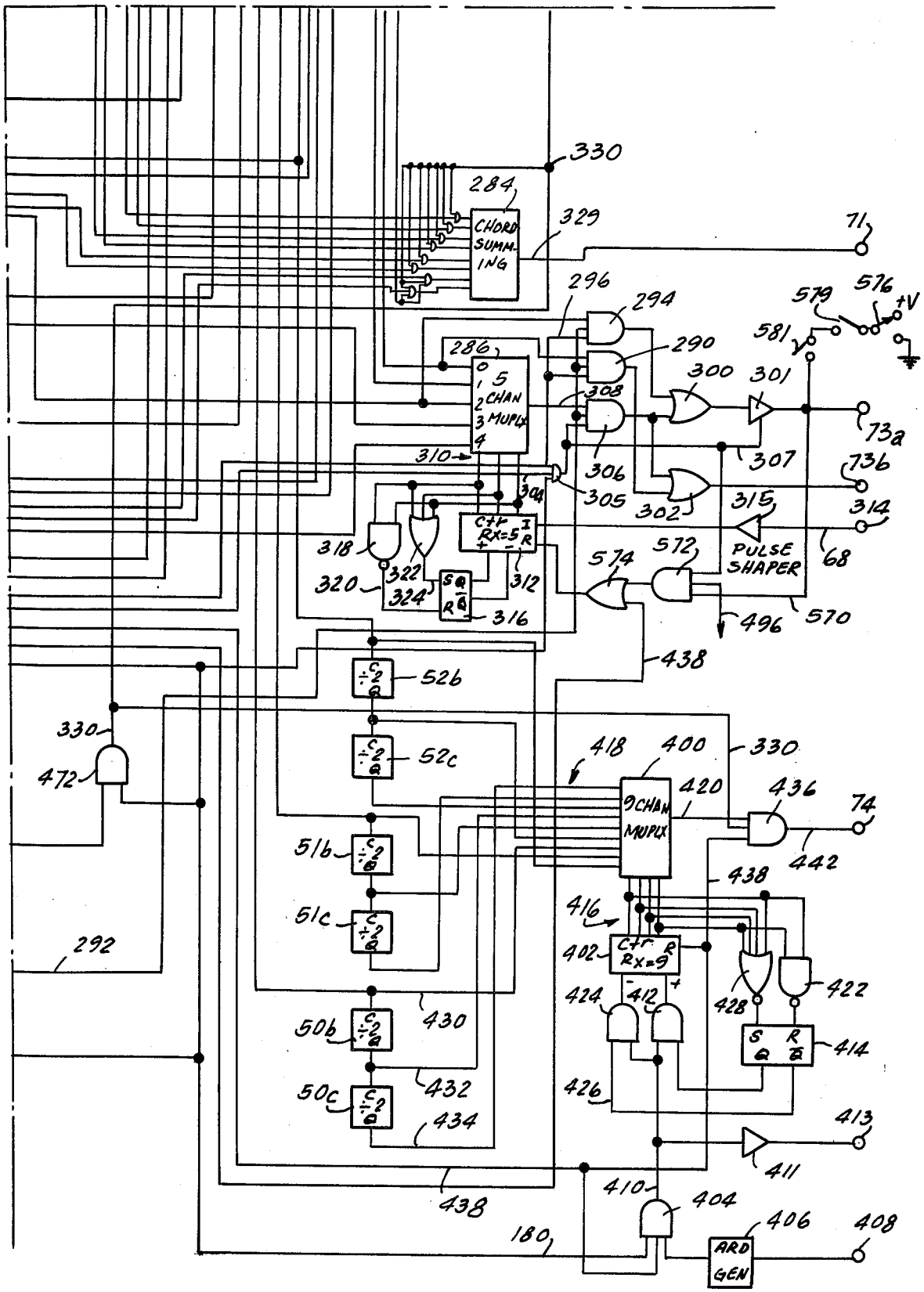
Figure 6:
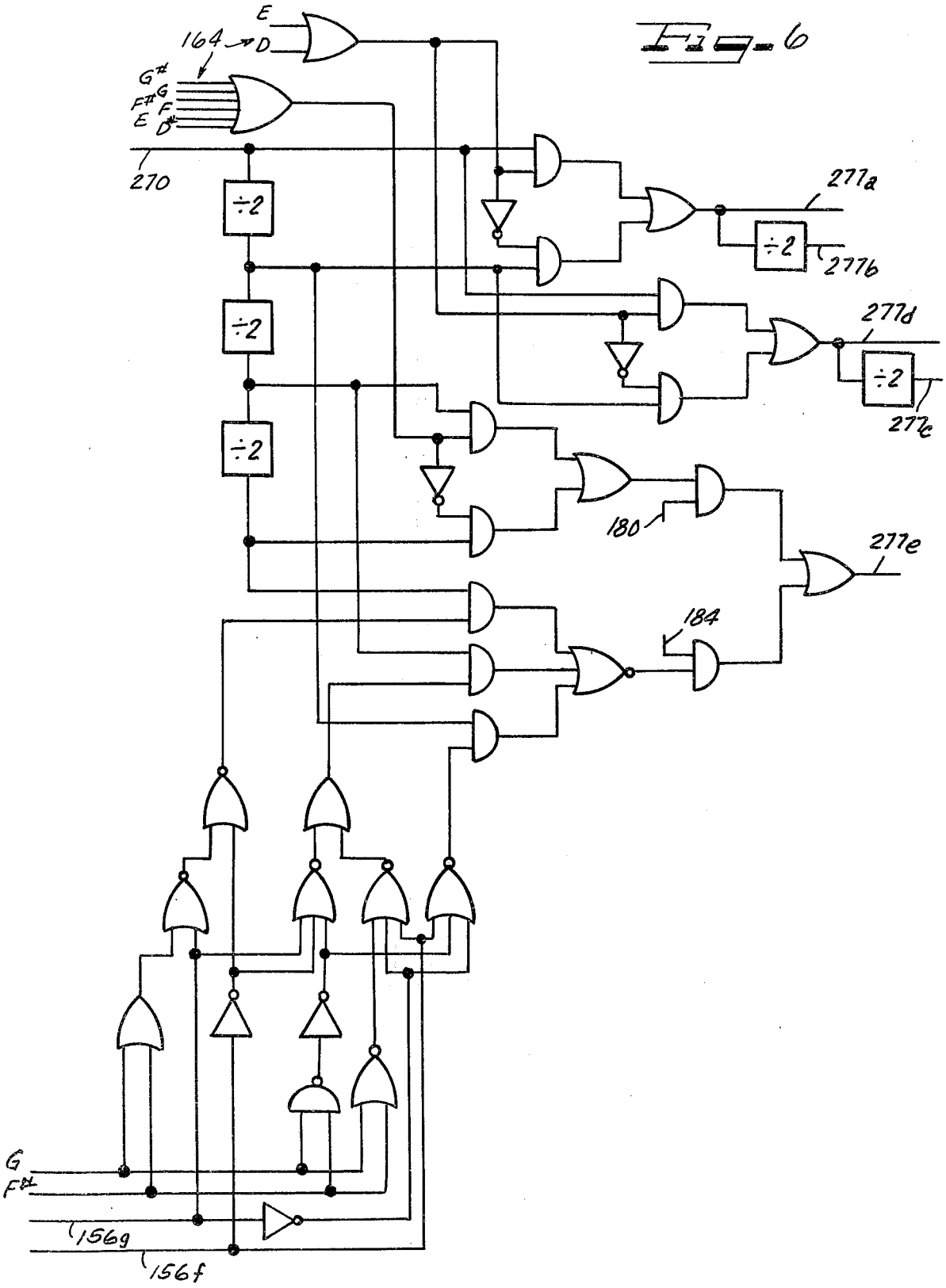
FIG. 6–10 are functional block diagrams of the divider control logic unit 272 and the divider units for the various chord components.
Figure 7:
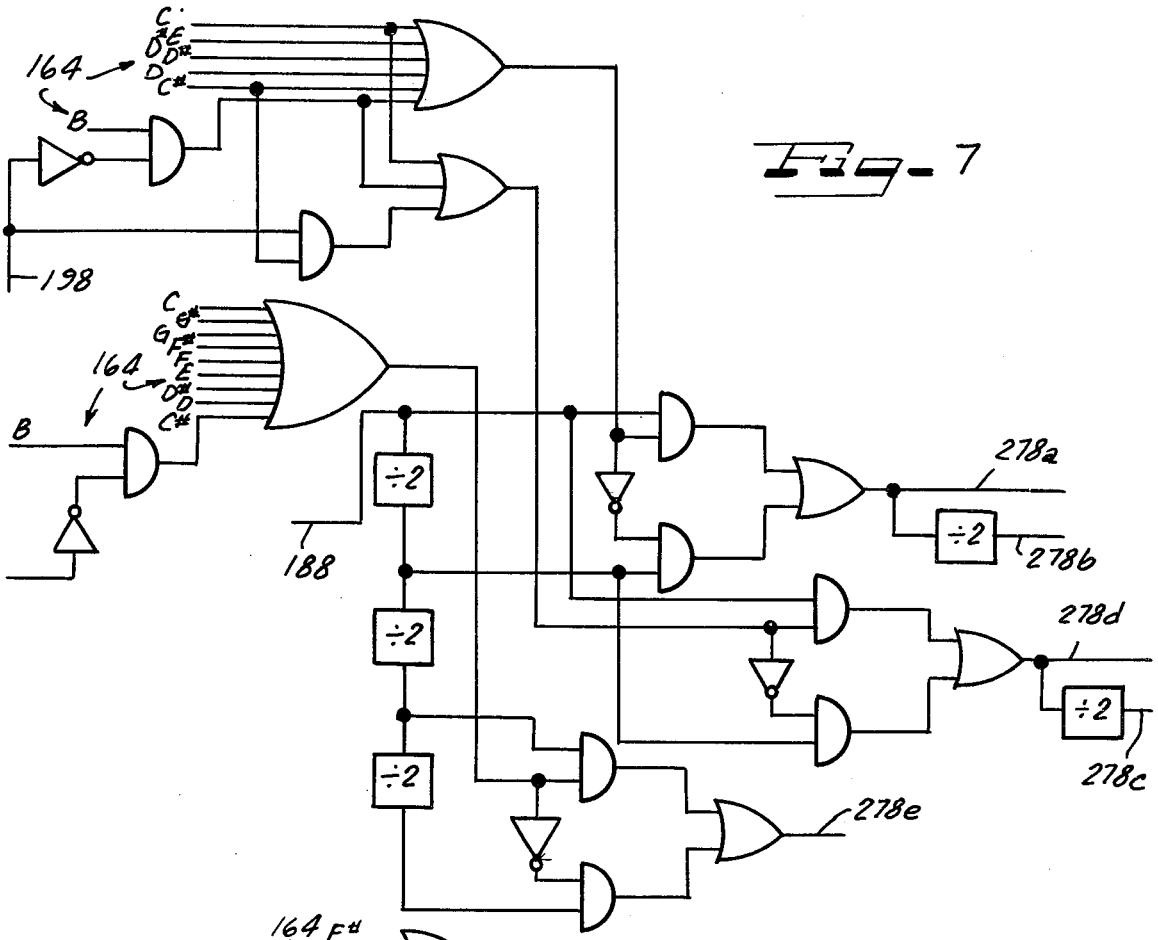
Figure 10:
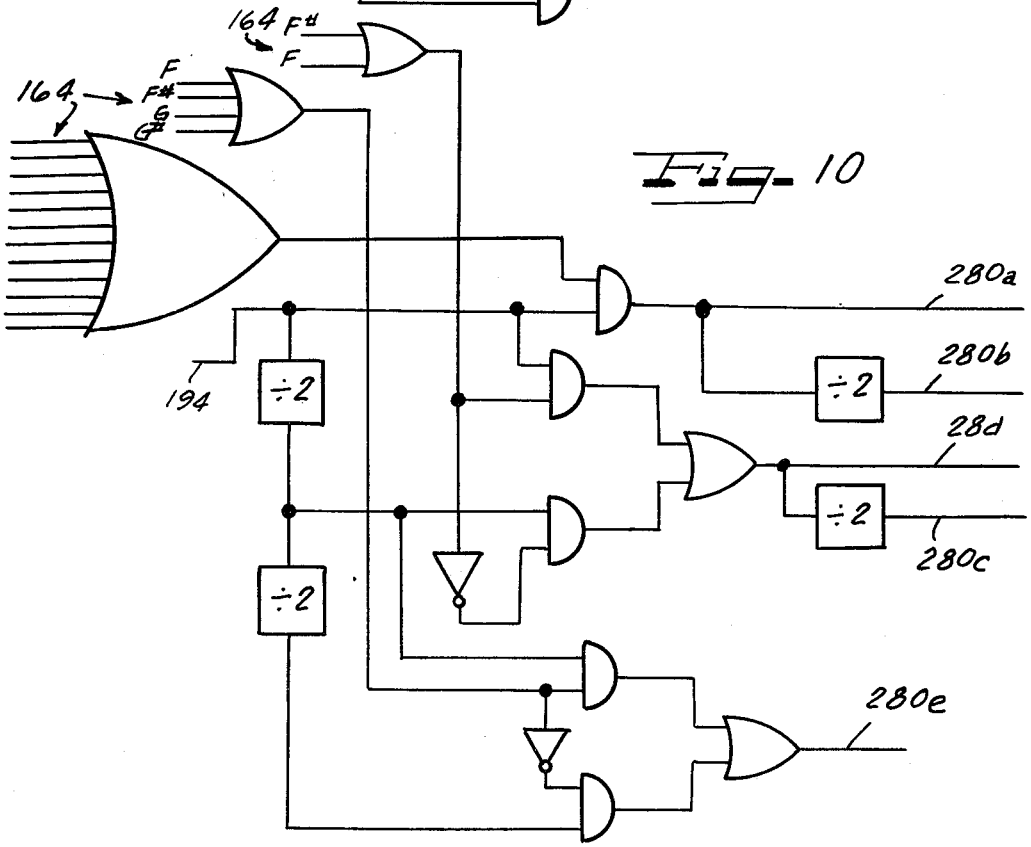
Figures 8, 9:
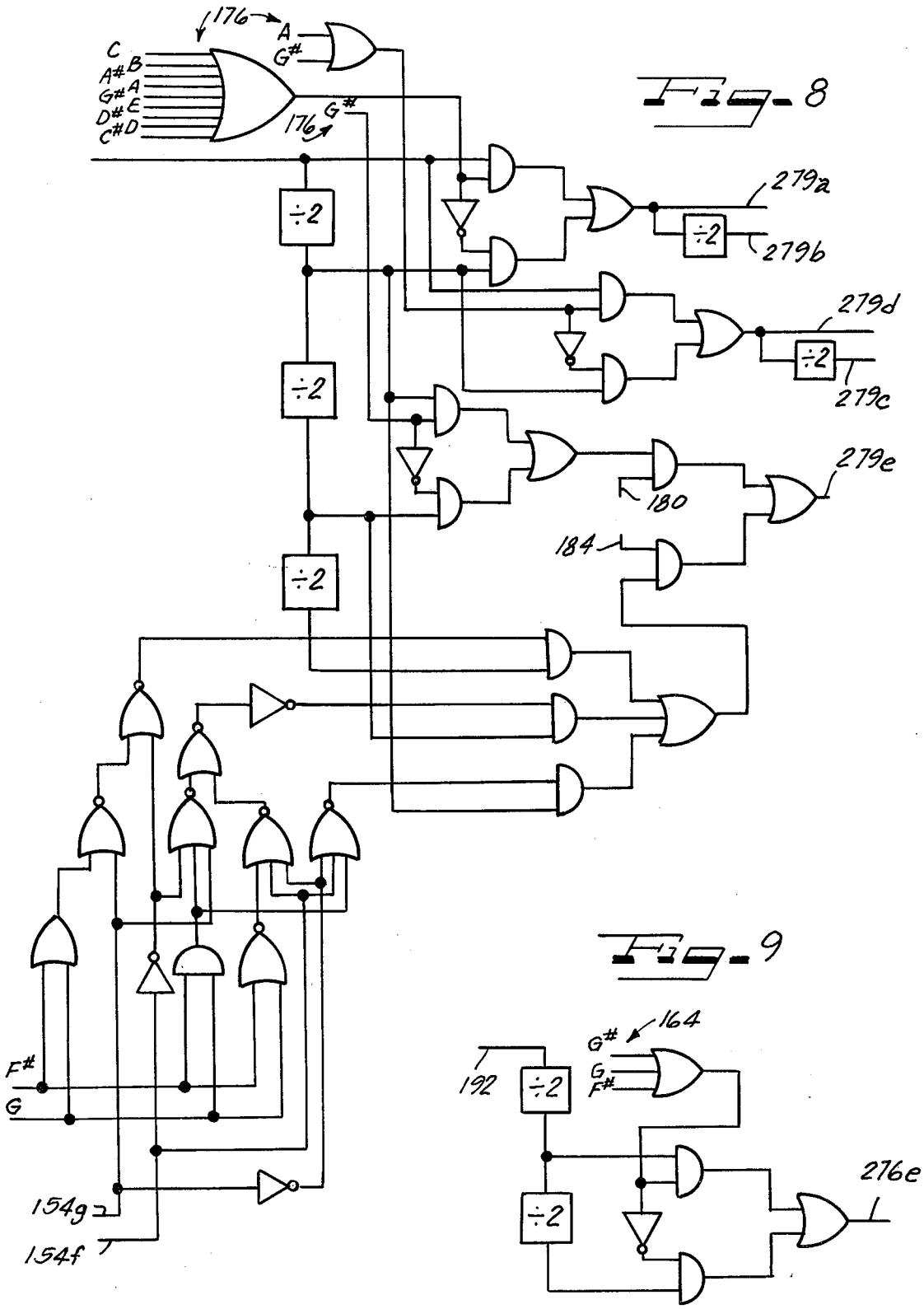

The divider units 50–57, which are provided for the several generators, incorporate individual divider units 50*a*–54*a* (FIGS. 4*b* and 4*e*) for the root, third, fifth, sixth and seventh tone signal generators, and additional divider units 50*b* and 50*c* for the root, 51*b* and 51*c* for the third, and 52*b* and 52*c* for the fifth tone signal generators (FIG. 4*f*).

The divider unit 50*a* receives its input from the PFS unit 168 of the root tone signal generator 54 over a line 270, and it receives three additional inputs over the lines 156*e*–156*g* from the D latches 148, representative of the octave associated with the note stored in the D latches 148.

The three inputs from the D latches 148 identify the octave or relative pitch in which the note is to be sounded by the output system. Since, in the hi-low mode, any of twenty-eight different keys may be responsible for setting the A–D latches, it is necessary, in order to produce output signals having pitches corresponding to the location of the operated keys, to identify the octave of the operated keys responsible for setting the A–D latches. Such keys may be in one of three different octaves. When a relatively high pitch key is depressed, fewer stages of frequency division are used to produce the output signals, whereas when a relatively low pitch key is depressed, more stages of division are included in the divider 50*a*.

The divider unit 50*a* incorporates a plurality of gates responsive to the signals represented on the lines 156*e*–156*g*, to select the number of dividers which are included in the divider chain between the input and the output of the unit 50*a*. Each individual divider stage in the chain is effective to reduce the pulse repetition rate of the input signal by a factor of two, so that when two divider stages are included in the chain, the frequency is reduced by a factor of four, etc.

The root divider unit 50*a* also receives an input from a divide control unit 272. The divide control logic unit 272 receives as inputs the twelve outputs of the one-of-twelve decoder 162. As described above, only one of these twelve outputs is effective or operative at any one time, and that one operates a gating network included within the divide control unit 272 to select combinations of output lines for controlling the various dividers 50*a*–54*a*. Several output lines 274 are connected from the divider control unit 272 to the divider units 50*a*–54*a* in several combinations. Two output lines 274*a* and 274*b* are connected between the control unit 272 and the root divider unit 50*a*; three lines 274*c*, *d* and *e* are connected between the control unit 272 and the third divider unit 51*a*; and three lines 274*f*, *g* and *h* are also provided for connecting the control unit 272 to the fifth divider unit 52*a*. A single output line connects the control unit 272 with the sixth divider unit 53*a*, and a pair of lines 274*j* and *k* interconnect the control unit 272 with the seventh divider unit 54*a*. Different numbers of lines are required because the various divider units are effective for different purposes during operation of the system in the performance of its several different functions.

A single output line 276 is connected to the sixth divider unit 53*a*, while five output lines 277–280 are connected to each of the other divider units.

Two of the output lines of each of the divider units 50*a*, 51*a*, 52*a* and 54*a* are connected to a strum circuit 282 which incorporates a plurality of gates and is employed for producing strum output signals on the output terminals 72. Two additional outputs of the divider units 50*a*, 51*a*, 52*a* and 54*a* are connected as inputs to a summing unit 284, which is effective to produce chord output signals on a terminal 71.

Anothe output from each of the divider units 50*a*–52*a* and 54*a* is connected to one input of a five-channel multiplexer 286, for producing bass output signals on the terminals 73.

The first output of each of the divider units 50*a*–52*a* is also connected to the inputs of divider units 50*b*, 51*b* and 52*b*, respectively, which are used in the production of an arpeggio output signal on the terminal 74.

Hi-Low Mode Operation

When the apparatus is in its hi-low mode, signified by the M flip-flop 244 being set, the unit functions to produce only a bass output on the terminals 73. The tone signals which are made available at these terminals correspond to the notes the representations of which are stored in the C and D latches. The C latches 144 store the representation of the note corresponding with the highest operated key of the lowest twenty-eight keys of the keyboard 10, while the representation stored in the D latches 148 corresponds to the lowest such operated key. The output of the D latches 148 controls the operation of the root tone signal generator 44, and a signal is produced on the output line 172 of the generator 44 corresponding with the pitch of a harmonic of the lowest note.

Similarly, the output of the C latches 144 controls operation of the fifth tone signal generator 46, since the M line 184 is high, the twelve outputs of the decoder 158 being connected through the gating unit 174 to the inputs of the generator 46. Accordingly, the pulse repetition rate of the signal on the output line 190 of the fifth generator 46, which is furnished to the input of the fifth divider unit 52*a*, corresponds to the highest operated note within that section of the keyboard.

The three lines 156*e*, *f* and *g*, identifying the octave of the note stored in the B latches 148, are supplied as inputs to the root divider unit 50*a*, and the corresponding three outputs of the C latches 144 are connected by the lines 154*e*, *f* and *g* to three inputs of the fifth divider unit 52*a*.

One output of the root divider unit 50*a* is connected by the line 277*e* to one input of an AND gate 290, the other input of which is connected to a line 292. Similarly, one output 279*e* of the fifth divider unit 52*a* is connected to one input of an AND gate 294, the other input of which is also connected to the line 292. Each of the gates 290 and 294 receive a third input from the line 296.

No other output terminals of the apparatus are effective when it is in its hi-low mode, with the flip-flop 244 set. There is a condition, however, in which the potential on the line 292 is low, so as to disable the bass gates 290, 294 and 306. This condition occurs when no key of the keyboard is depressed, and is explained hereinafter in connection with the latch operation.

The line 296 is the B line connected to the Q output of the B flip-flop 252, which is set when the bass pattern switch is closed. Accordingly, when the line 296 is high, the signals from the root and fifth divider units 50*a* and 52*a* are passed by the gates 294 and 290. The output of the gage 294 is connected to one input of an OR gate 300, the output of which is connected through a tri-state output buffer 301 to the terminal 73*a*. The unit 301 forms a conductive path during the hi-low mode, since the line 307, connected to its control input, is low. The output of the gate 290 is connected through an OR gate 302 to the terminal 73*b*. Accordingly, the root and fifth outputs are made available continuously on two separate output terminals 73*a* and 73*b*, so that they may be sounded alternately by gating means (not shown) connected to the terminals 73*a* and 73*b*. Such a gating means is also connected to suitable outputs of the rhythm unit 66, so that the root and fifth tones are sounded either individually or together, in accordance with the particular rhythm desired. Such a gating means is well known to those skilled in the art and, accordingly, will not be described in detail.

Automatic Chord Mode

When the automatic chord mode is selected, evidenced by the M flip-flop 244 being in its reset condition, a variety of additional functions are enabled, including two different bass patterns, two strum octaves, an arpeggio pattern, and minor and seventh options, in addition to the various components of a selected chord. These functions will now be described.

1. Root-Fifth Bass

The hi-low bass function remains operative, even in the automatic chord mode, but the fifth tone signal generator 46, in such case, produces an output signal which corresponds to the fifth of the selected chord, due to the operation of the gates 174, and the root tone signal generator 44 produces an output signal corresponding to the root of the selected chord. The fifth signal is passed by the gate 294 to the terminal 73*a* and the root signal is passed by the gate 290 to the terminal 73*b*, just as in the hi-low mode, provided the B line 296 is high; that is, when the B flip-flop 252 is set. The tri-state buffer 301 functions as an OR gate, since there is a low potential on the control line 307 when the B flip-flop is set.

2. Walking Bass

When the line 296 is not high, indicating that the bass pattern B flip-flop 252 is not set, the line 304, which is connected to the $\overline{Q}$ output of the B flip-flop 252, is high instead. It is connected to one input of an AND gate 305, the other input of which is connected to the $\overline{M}$ line 180, so that the gate 305 is enabled during the automatic chord mode, when the B flip-flop is set. The output of the gate 305 is connected to one input of an AND gate 306, which has a second input connected to the line 292 (which is normally high), and a third input connected to a line 308 from the output terminal of the five-channel multiplexer 286. The multiplexer 286 receives one input from each of the root, third, fifth, sixth and seventh divider units. One of these inputs is fed through to the output 308, in accordance with the state of a counter 312, the outputs of which are connected to the inputs of the multiplexer 286 over lines 310. The counter 312 is a three-stage binary counter, which is connected so as to have a radix of five. The input of the counter is connected from a terminal 314 over the line 68, through a shaper 315, from the rhythm unit 66 (FIG. 1). The counter 312 is counted either up or down, in response to pulses applied to the terminal 314, in accordance with the state of the flip-flop 316. When the flip-flop 316 is set, pulses applied over the line 68 are effective to increment the counter, to increase its state. When the state of the counter equals five, this is detected by a NAND gate 318, which produces a signal on a line 320 which resets the flip-flop 316. Thereafter, subsequent pulses applied to the line 68 decrement the counter, until the counter reaches its zero state, which is sensed by an OR gate 322, which then produces a pulse on line 324 to set the counter 316 and repeat the operation.

One of the five input signals applied to the multiplexer 286 is selected for connection directly to the output line 318, depending on the state of the counter 312. This output is passed through the AND gate 306, when its other two inputs are high, and through the OR gate 300 and the amplifier 302 to the output terminal 73*a*. The signals presented to the terminal 73*a* therefore constitute a walking bass, in which the root, third, fifth, sixth and seventh are sequentially presented to the terminal, first in an increasing direction and then in a decreasing direction. The speed at which the notes are changed corresponds to the speed of application of pulses to the input terminal 314.

The output of the gate 305 is connected to the control line 307, to disable the tri-state buffer 301, so that the output of the buffer 301 is essentially floating, and is not held at either a high or a low potential while the walking bass circuit is functional by the buffer 301. However, this terminal is held high or low by external switches 576, 579 and 581.

The terminal 73*a* is connected through switches 576, 577 and 579 to a source of positive potential at a terminal 577. The terminal 73*a* is also connected, by a line 570, to one input of an AND gate 572, the other inputs of which are connected to the line 307 and to a line 496 which is high when a new one of the lowest twelve keys of the keyboard is depressed. The output of the AND gate 572 is passed through an OR gate 574 to the reset input of the counter 312, so that the counter is automatically reset, when the walking bass is selected during the automatic chord mode, provided the switches 579 and 581 are closed, and the switch 576 is connected to a source of positive voltage. The switch 579 is closed when the switch selecting a bass pattern which sets the B flip-flop is closed, and the switch 581 is closed when the switch which sets the M flip-flop is open. This provides for automatic resetting and restarting of the automatic bass operation on the root tone signal each time a new chord-selecting key is depressed. If the switch 576 is grounded, the walking bass operation is not reset due to a new chord key being depressed.

In sum, the walking bass function, employing the root, third, fifth, sixth and seventh components of a selected chord, occurs only during the automatic chord mode, and presents the appropriate tone signals to the terminal 73*b*, from which they are connected to the keyers 20, which are operated as desired. The terminal 73*a* is nonfunctional as an output terminal, but functions as an input terminal for this function, to permit automatic resetting of the walking bass to the root tone signal upon depressing a new one of the lowest twelve keys of the keyboard, when this is desired.

3. Stair-Stepped Chord Output Signals

In the automatic chord mode, a composite chord signal, formed of a plurality of different tone signals, is supplied to an output terminal 71, from the output of the summing unit 284. The summing unit 284 constitutes a stair-stepping and mixing network. Two separate inputs are provided to it via gates 328*a*–328*g* from the divider units 50*a*, 51*a*, 52*a* and 54*a* for furnishing tone signals corresponding to the root, third, fifth and seventh of the selected chord. Each of the gates 328 has a second input connected to the line 330, which is high when this circuit is operative. Two gates 328*g* and 328*h*, which are connected from the seventh divider unit 54*a*, receives a third input from the line 384, which is high when the S flip-flop 378 is set, to add the seventh components to the chord. The two inputs connected from each divider unit carry two signals having frequencies which are in a two-to-one ratio, and the summing network 284 incorporates a network for attenuating the higher frequency signal of each pair of signals received from each divider unit, so as to form a separate step stair-step signal for each of the root, third, fifth and seventh components. The four stair-step signals are then summed together to produce a signal output, at the output terminal 71. The terminal 71 is connected to the keyers 20 (FIG. 1).

In sum, a composite signal, including components of the root, third, fifth and seventh of the selected chord, is continuously presented, as long as the line 330 presents a high voltage level. This occurs continuously during the automatic chord mode, as long as one of the lowest twelve keys of the keyboard is depressed or if the latch function is selected, and one of the keys has been previously depressed.

4. Strum Output Signals

The individual tone signals for the root, third, fifth and seventh are presented individually to terminals 72*a*–72*d*, so that they may be keyed individually if desired. The four output terminals 72*a*–72*d* are connected individually to the outputs of four AND gates 331–334. Each of the AND gates 331–334 has one input connected to the line 330, and a second input connected individually to one of four output lines 336, which lines are connected to the gating unit 282. A third input to the gate 334 is connected to the line 384 so that this gate is enabled only when the S flip-flop is set.

The gating unit 282 is effective to select the octave of the strum outputs which are applied to the terminal 72. Four sets of gates, which are identical, are included in the unit 282, so that only one set need be explained in detail. A first AND gate 338 has one input connected to one output of the root divider unit 50*a* over a line 277*a*, and a second gate 340 has one input connected to the second output of the root divider unit 50*a* over a line 277*b*. The second input of the gate 338 is connected to the Q output of the P flip-flop 250 over a line 342, while the second input of the gate 340 is connected to the $\overline{Q}$ output of the P flip-flop 250 over a line 344. Accordingly, either the gate 338 or 340 is enabled, depending on the state of the P flip-flop 250. The outputs of both gates 338 and 340 are connected to two inputs of an OR gate 346, the output of which is connected by a line 336*a* to one input of the gate 331, for furnishing a signal to the terminal 72*a* having a frequency proportional to the root of the selected chord. Three other sets of gates, each including two AND gates and an OR gate, are provided, each set being identical to that described, to furnish one of a pair of signals from the third, fifth and seventh divider units to their respective gates 332–334.

The keying pulses, by which the strum signals applied to the terminals 72 may be keyed, are furnished to a set of terminals 72 including four terminals 72*e*–72*h*. Both the strum tone signals, via the terminals 72*a*–72*d*, and the strum keying signals, via the terminals 72*e*–72*h*, are supplied to the keyers 20 (FIG. 1). The keying signal on the line 72*e* is connected to operate the keyer for the root tone signal, which receives its signal input from the root tone signal terminal 72*a*. Signals on the terminals 72*f*–72*h* are effective to control keying of the tone signals presented to terminals 72*b*–72*d* in the same way.

The rate of strum operation is determined by a strum clock generator 348. The strum clock generator 348 is a free running oscillator, which produces, on an output line 354, a series of pulses having a pulse repetition rate dependent on the time constant of an external R-C circuit connected to the terminal 350. The line 354 is connected to one input of an AND gate 356, the other input of which is connected to the Q output of an RS flip-flop 358. The flip-flop 358 is set by means of a signal applied to a terminal 360 and from the terminal over a line 362 through a wave shaper 364. The terminal 360 is supplied with a pulse whenever the strum is to be initiated, and signals are applied to the terminal 360 periodically. Such signals are preferably generated by the rhythm unit 66.

When the flip-flop 358 has been set, the gate 356 is effective to pass the strum clock pulses over a line 364 to a counter 366, which functions as the strum counter. The counter 366 has a radix of six, and five output lines 368, one of which is energized when the counter is in a non-zero state. They are energized individually in succession as the counter 366 is incremented by the pulses over the line 364.

Initially the counter is in its zero state, and none of the output lines 368 is energized. When it is incremented to state one, the first output line 368*a* is energized, after which the remaining lines 368*b*–368*d* are energized one at a time, as input pulses are received over the line 364.

The line 364 is also connected through a wave shaper 370 to a first input of each of a group of four AND gates 371–374. The second input of each of the gates 371–374 is connected to the line 330, which is normally high during the automatic chord mode, and a third input is connected individually to four outputs 368*a*–368*d* of the counter 366.

Two additional AND gates 375 and 376 provide signals for resetting the flip-flop 358 and the counter 366. One input of the AND gate 375 is connected to the fourth output 368*d* of the counter 366, and its second input is connected to the $\overline{Q}$ output of the S flip-flop 378 (FIG. 4*e*) over a line 380. The S flip-flop 378 is set by a signal over a line 382 from the SE flip-flop 255 (FIG. 4*d*), which is set in accordance with one of the function switches, as described above.

The AND gate 376 has one input connected to the fifth output 368*e* of the counter 366, and its other input connected over a line 384 to the Q output of the S flip-flop 378. When the S flip-flop 378 is not set, the AND gate 375 is enabled, and when it is set, the AND gate 376 is enabled. The gates 375 and 376 each have their outputs connected to an input of an OR gate 386, the output of which is connected to the reset input of the flip-flop 358 and to the reset input of the counter 366.

When the S flip-flop 378 is set, the gate 376 is effective to pass the signal occurring on the fifth output line 368*e* of the counter 366 to the reset input of the flip-flop 358. When the S flip-flop 378 is in its reset state, however, the leading edge of the signal on the fourth output line 368*d* is passed by the gate 375, and the flip-flop 358 is reset earlier by one period of the pulses produced by the strum clock generator 348. When the flip-flop 358 is reset by the signal on the fourth line 368*d*, the AND gate 356 is immediately disabled, and so there is no signal made available to the gate 374 via the shaper 370. Accordingly, no pulse is supplied to the output terminal 72*h*, and the tone signal for the seventh of the chord is not keyed.

In sum, a strum function is initiated, beginning with the root tone signal, each time a pulse is presented to the terminal 360 (from the rhythm unit 66). The pitch of the strum tone signals are in one of two octaves, depending on the condition of the P flip-flop 250, and the seventh of the chord is present or not, depending on the condition of the S flip-flop 378.

5. Arpeggio

When an arpeggio function is desired, a nine-channel multiplexer 400 (FIG. 4*f*) is employed in association with a counter 402 having a radix of nine. The counter 402 is counted either up or down by pulses produced by an AND gate 404, the three inputs of which are connected to the $\overline{M}$ line 180, the line 438 from the A flip-flop, and to the output of an arpeggio clock generator 406 which has an input connected to an input terminal 408. The clock generator 406 is an oscillator like the strum clock generator 348, but is preferably synchronized by pulses applied from an external source via a terminal 350 over a line 352. When the $\overline{M}$ line 180 is high (during the automatic chord mode), the AND gate 404 is effective to pass pulses to a line 410. The line 410 is connected to one input of an AND gate 412, the other input of which is connected to the Q output of a flip-flop 414. When the flip-flop 414 is set, the AND gate 412 is conditioned to pass pulses to the upcounting input of the counter 402, to increment the counter 402 with each pulse from the generator 406. The counter 402 is a four-stage binary counter, and a plurality of output lines 416, one from each stage of the counter, are connected to the inputs of the multiplexer 400. The multiplexer 400 functions to connect one of the input lines 418 to the output line 420, in accordance with the state of the counter 402.

The output of an inverter 422 goes low to serve when the counter 402 reaches the state corresponding to a count of eight, and resets the flip-flop 414. The AND gate 412 is thus disabled, and another AND gate 424 is enabled, by virtue of the line 426 connecting one of its inputs to the $\overline{Q}$ output of the flip-flop 414. The other input of the AND gate 424 is connected to the line 410, and its output is connected to the down-counting input of the counter 402. Accordingly, the counter 402 is counted downwardly after reaching the state corresponding to a count of eight. When the counter 402 is counted down to zero, that state is detected by a gate 428, the output of which sets the flip-flop 401 to resume upward counting of the counter 402.

The nine inputs to the multiplexer 400 are derived from the first outputs of the divider units 50*a*–52*a* for the root, third and fifth and from the auxiliary divider units 50*b*–52*c*.

The input of the divider unit 50*b* is connected to the first output of the root divider unit 50*a*, which is also connected directly to the multiplexer 400, over a line 430. The output of the divider unit 50*b* is connected to the input of the divider 50*c*, and also directly to the multiplexer 400 over a line 432. Similarly, the output of the divider unit 50*c* is connected to the multiplexer 400 over a line 434. The divider units for the third and fifth are connected in a similar fashion, and together they provide nine inputs to the multiplexer 400.

The input connections to the multiplexer 400 are arranged, in FIG. 4*f*, in order of their pitch, and supply tone signals for root, third and fifth tones over a range of three octaves. As the counter 402 is counted up and down, the multiplexer 400 sequentially connects the inputs, one at a time, to the output 420, at a rate determined by the operation of the clock 406.

The output line 420 is connected to one input of an AND gate 436, which has its other two inputs connected to lines 438 and 330. The line 438 is connected to the Q output of the A flip-flop 256, and is high whenever the A flip-flop is set, viz., when the arpeggio function is selected. The line 330 is high whenever one of the lowest twelve keys of the keyboard is depressed, so that the tone signals of the selected chord are presented to the output line 420 of the multiplexer 400, and are passed by the AND gate 436 to the output terminal 74.

The line 438 is also connected to the reset input of the counter 402, to reset the counter to its zero state whenever the A filp-flop 256 is reset. This insures that the first note of an arpeggio begins with the root tone signal. The output of the AND gate 404 is connected through a shaper 411 to a terminal 413, which is preferably connected to a keyer for the arpeggio tone signals. A new tone signal is provided to the terminal 74 coincident with each pulse provided to the terminal 413.

In sum, a three-octave arpeggio, including tone signals corresponding to the root, third and fifth of a selected chord, are presented to the output terminal whenever the A flip-flop 256 is set during the automatic chord mode. Resetting the counter at the end of each arpeggio operation insures that each operation starts with the root tone signal.

6. Key-Release Disable

Signals on the lines 292 and 330, which are required for operation of the circuits which produce strum output signals, the chord output signals, the arpeggio output signals, and the bass output signals, are generated by a logical circuit which responds to an indication that one of the keys of the keyboard, within the range of keys which produce pulses during the window interval, has been depressed during the previous cycle of operation of the multiplexer, or to a signal indicative of setting of the L flip-flop 253.

A KD flip-flop 450 (FIG. 4*e*) has its D input connected by a line 452 to the Q output of the FN flip-flop 218, and its C input connected by a line 454 to the output of AND gate 268, which produces a signal at pulse time 72. Since the FN flip-flop 218 is set by any data appearing on the line 222 during the window interval, the line 452 goes high at pulse time 72, and the KD flip-flop 450 is set at that time if the FN flip-flop 218 has been set, to produce a signal from its Q output on a line 456. A signal on the line 456 is indicative of the fact that an appropriate key has been depressed during the previous cycle. A line 456 is connected to one input of an NOR gate 458, which forms an RS flip-flop 459 together with another NOR gate 460, the gates 458 and 460 being cross-coupled. One input of the NOR gate 460 is connected to the output of an OR gate 462, the inputs of which are connected to the power-on reset or POR line 464 and to a line 466 which is connected to the Q output of the flip-flop 253. The line 466 is high when the L flip-flop 253 is not set, and is low when the flip-flop is set. A high level on the line 456 is the setting signal for the flip-flop 459, and a high level on the output of the OR gate 462 resets the flip-flop 459. In order to set the flip-flop 459, the output of the gate 462 must be low while the line 456 is high. The set condition, signifying that the L flip-flop 259 is set and that an appropriate key has been depressed, is manifested by a high level output from the gate 460. It is used to provide high levels on the lines 292 and 330, as will now be described.

The output of the NOR gate 460 is connected to one input of an OR gate 468, the other input of which is connected directly to the line 456. The output of the OR gate 468 is connected to one input of an AND gate 472, the other input of which is connected to the line 180, which is high during the automatic chord mode. The output of the AND gate 472 is connected to the line 330. Accordingly, line 330 is high during the automatic chord mode, provided either (1) there has been a key depression during the previous cycle (i.e., a signal on the line 456) or (2) the flip-flop 459 has been set by a key being depressed while the L flip-flop 253 was set, and the L flip-flop remains set, indicating selection of the latch function.

The output of the NOR gate 460 is also connected to an input of an AND gate 480, the other input of which is connected to the line 180. The output of the AND gate 480 is connected to one input of an OR gate 482, the other input of which is connected directly to the line 456. The output of the OR gate 482 is connected to the line 292. Accordingly, the line 292 is high whenever a signal appears on a line 456, signifying depression of an appropriate key during the previous cycle, or, in the automatic chord mode, when the flip-flop 459 has been set in either mode. A high level on the line 292 enables the bass outputs in both modes, while the line 330 enables all other output functions.

When the L flip-flop 253 is reset, terminating the latch operation, the gate 462 produces an output which causes the immediate resetting of the flip-flop 459. This disables all outputs unless an appropriate key remains depressed, furnishing a signal on the line 456.

Unless the flip-flop 459 is set, the releasing of all of the keys in the chord determining or hi-low determining portion of the keyboard disables all of the output signals, via the lines 292 and 330, so that releasing the keys interrupts the sounds resulting from the various output signals.

7. New Key Signal

When a new chord is selected, in the automatic chord mode, it is sometimes desirable to restart the walking bass at the root note of the new chord, and it is also desirable to produce the new chord in a major key. Therefore a signal must be developed when the selected chord is changed. The apparatus by which this is accomplished will now be described.

A comparator 490 has four input lines connected to the note indicative output lines of the B latches 134, and four additional input lines connected to the note indicative outputs of the D latches 148. Normally these two groups of lines all bear the same information, so a comparison output is produced from the comparator 490 on a line 492, indicating that the B and D latches store the same information. When a new chord is selected, by depression of a different (or a higher) one of the lowest twelve keys of the keyboard, while maintaining the key for the previous chord depressed, the B latches 134 are changed during one cycle of operation, and the D latches 148 are not changed correspondingly until the end of the cycle. Accordingly, there is a period at which the level on the output line 492 goes low, which is indicative of a new chord being selected. The line 492 is connected through an inverter 494 to a line 496, which is connected to one input of a NOR gate 498 (FIG. 4*e*), the output of which is connected to the reset inputs of the N flip-flop 377 and the S flip-flop 378. Accordingly, if a chord has previously been minored (by operation of the N flip-flop) or the seventh added to it (by operation of the S flip-flop), selection of a new chord will remove the minor and seventh from the new selected chord immediately. This occurs even though the key for the previous selected chord is not released.

The line 496 is also connected to one input of the AND gate 572 (FIG. 4*f*) to reset the walking bass counter 316, provided the switch 577 is closed, as described above.

8. Same Key Reset of Minor and Seventh

It has been described above that selection of a new chord automatically resets the flip-flops which had been previously set if the preceding chord was minored or had a seventh added to it. It is also desirable to reset these functions, automatically, when the same chord is selected, so that both functions can be released together and the chord returned to a major key. This additional function is performed by circuitry which will now be described.

A line 500 connects a second input of the OR gate 498 to the power-on reset line, and a line 502 connects a third input of the gate 498 to the Q output of a flip-flop 504. The flip-flop 504 produces a pulse when any key is first depressed, so that the minor and seventh flip-flops 377 and 378 are immediately reset. The flip-flop 504 is operated in the following way.

The KD flip-flop 450 is set at pulse time 72 at the end of each cycle in which the FN flip-flop 218 has been set, in recognition of an appropriate key having been depressed during that cycle. If that key remains depressed during successive cycles, the KD flip-flop 450 remains set. Its Q output is connected by a line 506 to the clock input of a D-type flip-flop 508, the D input of which is connected to a source of positive voltage by a line 510. The flip-flop 508 is set when by the leading edge of the signal on the line 506. When the flip-flop 508 is set, its Q output goes high. The Q output is connected to the D input of the D-type K flip-flop 504, and the clock input of the K flip-flop 504 is connected to the clock pulse source by a line 512. Accordingly, at the next leading edge of the clock signal, the K flip-flop 504 is set, as the flip-flop 508 has previously been set. As soon as the flip-flop 504 is set, its $\overline{Q}$ output goes low, and this output is connected by a line 514 to the reset input of the flip-flop 508, so the flip-flop 508 is immediately reset, thus removing the high potential from the D input of the K flip-flop 504. The subsequent clock pulse on the line 512 resets the K flip-flop 504. Accordingly, there is produced at the Q output of the K flip-flop 504 a pulse of one clock cycle in length, following the setting of the KD flip-flop 450. This pulse is connected by the line 502 through the OR gate 498 to reset the N and S flip-flops 377 and 378 each time a new key is depressed.

Serial Data Output

As described above, the pulses present on the data line 130 contain pulses responsive to operation of switches by depression of keys of the keyboard and operation of some of the function switches. In the automatic chord mode, there may be only a single pulse on the line 130, in response to operation of the keyboard keys, as only one key need be depressed in order to cause the apparatus to function in its automatic chord mode. It is desirable to add to the one or more pulses on the line 130 additional pulses which are representative of the note of a selected chord during the automatic chord mode, so that a pulse train is available for use in connection with the production of other sounds and tone signals, beyond those produced by the present invention. This function is performed by circuitry which is illustrated mostly in FIGS. 4*d* and 4*e*, and will now be described.

A comparator 520 (FIG. 4*a*) has four inputs connected to the note indicative inputs of the B latches 134 and another four inputs connected to the note indicative outputs of the B latches 134. A comparison exists of the signals on these lines only when the state of the counter 108 corresponds to the information stored in the B latches 134. This occurs at all the pulse times at which are being scanned the keys corresponding to the note indicative information stored in the B latches 134, and at these pulse times the comparator 520 produces an output pulse on a line 522. This pulse is used as a strobe pulse, and identifies the pulse time associated with the operated key of the keyboard, and other keys of the same note name, which selects the root of a selected chord (in the automatic chord mode).

The line 522 is connected to the input of a two-bit shift register 524 (FIG. 4*e*) the output of which is connected through a three-bit shift register 526, then a three-bit shift register 528, and finally a one-bit shift register 530. A line 532 connects all of the shift registers 524–530 to a source of clock pulses, so that pulses are produced at the outputs of the respective shift registers 524–530 at various pulse times following the time of occurrence of a pulse on the line 522. The pulse produced at the output of the shift register 524 is indicative of the next lower keyboard key corresponding to the seventh of the chord having its root identified by the pulse time of the pulse on the line 522. The output of the shift register 526 is indicative of the next lower keyboard key corresponding to the fifth of that chord, and the ouputs of the shift registers 528 and 530 are indicative of keys for the major and minor third, respectively, of that chord.

The output of the shift register 524 is connected to the input of an AND gate 534, which receives a second input from the ouput of the S flip-flop 378. If the S flip-flop 378 is set, indicating selection of a seventh component for the selected chord, the AND gate 534 produces an output pulse two clock times after the pulse arrives on the line 522. Both the line 522 and the output of the AND gate 534 are connected as inputs of a multiple-input OR gate 536.

The output of the shift register 526 is connected as a third input to the OR gate 536. The output of the shift register 528 is connected as one input of an AND gate 538, which receives a second input from the $\overline{Q}$ output of the N flip-flop 377. This output is high if the N flip-flop has not been set, in which case the AND gate 538 produces an output pulse in response to a pulse from the output of the shift register 528, for the major third. The output of the AND gate 538 is connected as a further input to the OR gate 536.

The output of the shift register 530 is connected to one input of an AND gate 540, the second input of which is connected to the Q output of the N flip-flop 377. The output of the AND gate 540 is connected to a further input of the OR gate 536. If the N flip-flop 377 is set, the output of the shift register 530 is applied to the OR gate 536, which adds a pulse corresponding to the minor third. Only one of the major and minor third pulses is produced, in accordance with the state of the N flip-flop 377.

The output of the OR gate 536 is connected to one input of an AND gate 542. Three other inputs of the AND gate 542 are connected to the line 180 (high during the automatic chord mode), the line 208 (high during the window interval), and the output of an OR gate 544 (FIG. 4*e*). The OR gate 544 receives one input from the Q output of the KD flip-flop 450, which is high when a chord selecting key has been depressed. Thus, the AND gate 542 passes the pulses produced by the OR gate 536 during the window period of the automatic chord mode, provided that a chord-selecting key has been depressed, to an output line 548. These pulses correspond to the components of the selected chord which occur during the window period.

A second input to the OR gate 544 is connected to the Q output of a flip-flop 546, which is set when the L flip-flop 253 is set, and a chord-selecting key has been depressed. Thus, the pulses for the various components are passed by the gate 542 to the line 548, even with no key depressed, as long as the latch function is selected and a chord-selecting key has previously been depressed. The Q output of the L flip-flop 253 is connected by a line 550 to one input of an AND gate 552, the other input of which is connected to the Q output of the KD flip-flop 450 over a line 456. The AND gate 552 thus produces an output when the KD flip-flop 430 and the L flip-flop 253 are both in their set states, and this occurs when a chord-selecting key is depressed and the latch function is selected. The output of the AND gate 552 is passed over a line 554 to the set input of the flip-flop 546.

An OR gate 556 has one input connected by the line 558 to the power-on reset line, and another input connected to the $\overline{Q}$ output of the L flip-flop 253, via the line 466. The output of the OR gate 556 is connected to the reset input of the flip-flop 546 to reset it, whenever the L flip-flop 253 is reset. Accordingly, the flip-flop 546 continues to be set after a key is operated, during a latch operation, only as long as the L flip-flop 553 remains set.

The line 548 is connected to one input of an OR gate 560, the output of which is applied to a terminal 562. The serial data output is thus made available at the terminal 562. Another input of the OR gate 560 is connected to the output of an AND gate 566, which has one input connected to the data line 130, a second input connected to the line 180 (high during the automatic chord mode), and a third output connected to the $\overline{Q}$ output of the W flip-flop 206. Since the flip-flop 206 is set only during a window period, its $\overline{Q}$ output is high during non-window periods. Accordingly, the AND gate 566 passes all pulses appearing on the line 130, when the automatic chord mode is selected, which do not arrive during the window interval. Window interval pulses are supplied by the line 548, and include the pulse appearing on the line 522, and selected pulses from the shift registers 524–530.

In sum, during automatic chord operation, the serial data supplied to the terminal 562 comprises the pulses indicative of the components of the selected chord, plus all other pulses arriving outside the window interval, i.e., pulse times 1-52 and 65-72.

Another input to the OR gate 560 is connected from the output of an AND gate 564. It has one input connected to the data line 130 and another input connected to the line 184 (which is high during the hi-low mode). Accordingly, during the hi-low mode, all of the pulses produced in response to key depression are supplied over the line 130 through the AND gate 564 and the OR gate 560 to the serial data output terminal 562. No pulses are added by the gates 452 and 566 because they are disabled during this mode.

Synchronizing

A synchronizing terminal 570 is provided for receiving or supplying a synchronizing pulse. A pulse is supplied to this terminal from the output of the AND gate 268 at pulse time 72. This pulse may be used by external apparatus, for synchronization purposes in connection with the serial data output applied to the terminal 562. The time position of the pulses appearing on the terminal 562 has significance in reference to pulse time 72 (the end of a cycle) which is identified by the pulse applied to the terminal 570.

The terminal 570 may also be used as a sync input terminal for synchronizing the apparatus of the present invention in accordance with some external source of pulses. Pulses applied to the terminal 570 are connected to the line 172 for setting the C and D latches 144 and 148, and are also effective to reset the FN flip-flop 218 and to set or reset KD flip-flop 450, in accordance with the state of the FN flip-flop 218.

Divide Control Logic and Divider Units

The divide control logic unit 272 controls the various divider units so that the outputs having the appropriate pulse repetition rates are produced for the various functions. The name of the selected chord, as represented by which of the lines 164 is energized, is the primary source of data for the operation of the divide control logic unit 272. The precise function of the divide control logic unit 272, in association with logical circuits in the various divider units **50*a*-54*a*, is to determine the number of divider stages interconnected between the signal input of the unit from its associated tone signal generator 44-48 and each of the several output lines of the divider units, leading to the strum unit, the chord output network, and the other output circuits. The several lines are indicated by letters in FIGS. 4*b* and 4*e*. All of the divider units 50*a*-54*a* have five output lines a-e, except for the sixth divider unit 276, which has only a single e output line. The output lines 277*a*-277*e* of the root divider unit 50*a* are connected in a manner which is typical for all of the divider units. The output line 277*a* is connected to the arpeggio circuit and to the strum unit, and furnishes the higher of two pitches to the strum unit. The output line 277*b* is connected to the strum unit to furnish the lower of the two strum pitches. The output lines 277*c* and 277*d* supply the two signals, having their frequencies in a two-to-one ratio to the chord summing circuit, and the output line 277*e*** supplies the root or low signal to the bass circuit. In the preferred embodiment, the number of frequency divider sections included in the path between the input of each divider unit and its several output lines is illustrated in the following table, which lists the divisor to be applied to the input pulse repetition rate (the dividend) for each output line of each divider unit for the root, third (major), third (minor), fifth, sixth and seventh chord components:

Table 1

| | | A | A# | B | C | C# | D | D# | E | F | F# | G | G# |
|---|---|---|---|---|---|---|---|---|---|---|---|---|---|
| Arpeggio and Strum II a | R | 2 | 2 | 2 | 2 | 2 | 2 | 1 | 1 | 2 | 2 | 2 | 2 |
| | 3M | 2 | 2 | 1 | 1 | 1 | 1 | 1 | 1 | 2 | 2 | 2 | 2 |
| | 3m | 2 | 2 | 2 | 1 | 1 | 1 | 1 | 1 | 2 | 2 | 2 | 2 |
| | 5 | 1 | 1 | 1 | 1 | 1 | 1 | 1 | 1 | 2 | 2 | 2 | 1 |
| | 7 | 1 | 1 | 1 | 1 | 1 | 1 | 1 | 1 | 1 | 1 | 1 | 1 |
| Strum I b | R | 4 | 4 | 4 | 4 | 4 | 4 | 2 | 2 | 4 | 4 | 4 | 4 |
| | 3M | 4 | 4 | 2 | 2 | 2 | 2 | 2 | 2 | 4 | 4 | 4 | 4 |
| | 3m | 4 | 4 | 4 | 2 | 2 | 2 | 2 | 2 | 4 | 4 | 4 | 4 |
| | 5 | 2 | 2 | 2 | 2 | 2 | 2 | 2 | 2 | 4 | 4 | 4 | 2 |
| | 7 | 2 | 2 | 2 | 2 | 2 | 2 | 2 | 2 | 2 | 2 | 2 | 2 |
| Chord c | R | 4 | 4 | 4 | 4 | 4 | 4 | 2 | 2 | 4 | 4 | 4 | 4 |
| | 3M | 4 | 4 | 2 | 2 | 4 | 4 | 4 | 4 | 4 | 4 | 4 | 4 |
| | 3m | 4 | 4 | 4 | 2 | 2 | 4 | 4 | 4 | 4 | 4 | 4 | 4 |
| | 5 | 2 | 4 | 4 | 4 | 4 | 4 | 4 | 4 | 4 | 4 | 4 | 2 |
| | 7 | 4 | 4 | 4 | 4 | 4 | 4 | 4 | 4 | 2 | 2 | 4 | 4 |
| Chord d | R | 2 | 2 | 2 | 2 | 2 | 2 | 1 | 1 | 2 | 2 | 2 | 2 |
| | 3M | 2 | 2 | 1 | 1 | 2 | 2 | 2 | 2 | 2 | 2 | 2 | 2 |
| | 3m | 2 | 2 | 2 | 1 | 1 | 2 | 2 | 2 | 2 | 2 | 2 | 2 |
| | 5 | 1 | 2 | 2 | 2 | 2 | 2 | 2 | 2 | 2 | 2 | 2 | 1 |
| | 7 | 2 | 2 | 2 | 2 | 2 | 2 | 2 | 2 | 1 | 1 | 2 | 2 |
| Auto Chord Mode Bass | R | 8 | 8 | 8 | 8 | 8 | 8 | 4 | 4 | 4 | 4 | 4 | 4 |
| | 3M | 8 | 8 | 4 | 4 | 4 | 4 | 4 | 4 | 4 | 4 | 4 | 4 |
| | 3m | 8 | 8 | 8 | 4 | 4 | 4 | 4 | 4 | 4 | 4 | 4 | 4 |
| | 5 | 4 | 4 | 4 | 4 | 4 | 4 | 4 | 4 | 4 | 4 | 4 | 2 |
| | 6 | 4 | 4 | 4 | 4 | 4 | 4 | 4 | 4 | 4 | 2 | 2 | 2 |
| | 7 | 4 | 4 | 4 | 4 | 4 | 4 | 4 | 4 | 2 | 2 | 2 | 2 |
| | | Hi-Low Mode | | | | | | (Root and Fifth) | | | | | |
| Oct. #6 e | | 4 | 4 | 4 | 4 | 4 | 4 | 2 | 2 | 2 | 2 | 2 | 2 |

Table 1-continued

| | A | A# | B | C | C# | D | D# | E | F | F# | G | G# |
|---|---|---|---|---|---|---|---|---|---|---|---|---|
| Oct. #5 e | 2 | 2 | 2 | 2 | 2 | 2 | 1 | 1 | 1 | 1 | 1 | 1 |
| Oct. #4 e | 1 | 1 | 1 | 1 | — | — | — | — | — | — | — | — |

The divisors indicated for the third (major) are employed if the voltage level on the line 196 is low, indicating the N flip-flop 254 is not set. Otherwise the number of dividers shown for the third (minor) is employed.

The divide control logic unit 272 contains a series of OR gates for supplying various control signals to the several divider units so that the appropriate number of frequency divider stages is included for every situation. Each of the divider units contains a plurality of dividers, connected in cascade to the signal input from its respective tone signal generator, and a network of AND and OR gates for selecting the output of the appropriate divider stage for connection to the various output lines. Given the number of dividers to be included in each case, as shown in FIG. 1, anyone skilled in the art can, by straightforward methods, design and construct a suitable gating network for each divider unit, and so the entire network including the OR gates within the divide control logic unit 272 and the gates included in the several divider units will not be described in detail. They are, however, illustrated for the various divider units in FIGS. 6–10.

Tone Signal Generators

Figure 11:
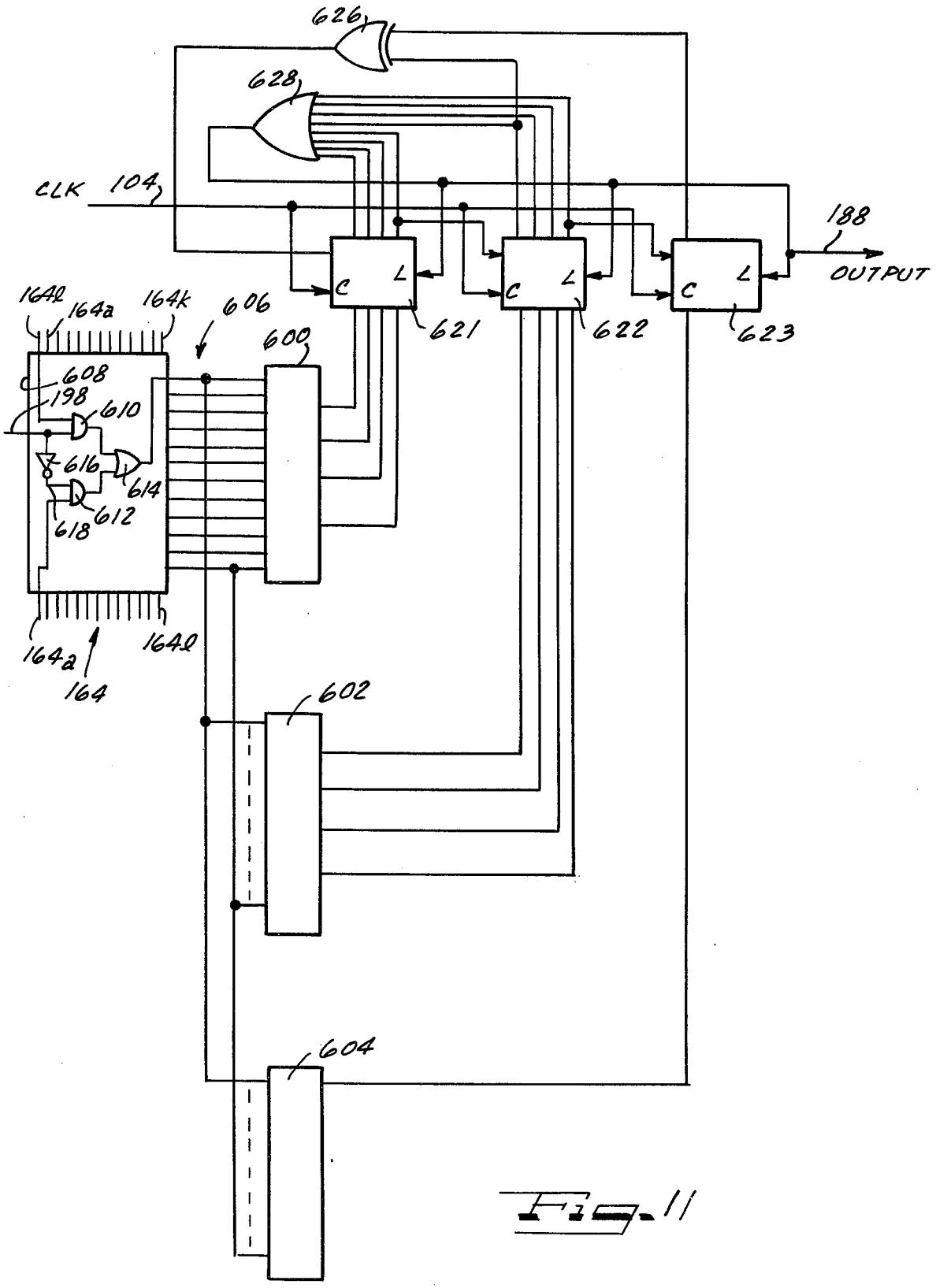
FIG. 11 is a functional block diagram of one of the tone signal generators.

Referring now to FIG. 11, a functional block diagram for the third tone signal generator 45 is shown. It incorporates a ROM having three sections 600, 602 and 604, and each section is connected to twelve input lines 606. The lines 606 are derived from the lines 164 in the third generator by means of the gating unit 608. The gating unit 608 incorporates twelve identical circuits, only one of which is shown in FIG. 11, in the interest of clarity. Each gating circuit is connected to two different (adjacent) lines of the lines 164, shown in FIG. 11 as connected to the gating circuit 608 at both top and bottom. The gating circuit shown is connected to the lines **164*a* and 164-1; others are connected to 164*a* and 164*b*, 164*b* and 164*c***, etc.

In the gating circuit shown, the line 164-1 is connected to one input of a first AND gate 610, and the line **164*a* is connected to one input of an AND gate 612. Both AND gates have their outputs connected to two inputs of an OR gate 614, the output of which is connected to one of the output lines 606. The second input of the gate 610 is directly connected to the line 198, while the second input of the gate 612 is connected to the line 198 through an inverter 616 and line 618. Thus the gate 610 is enabled when the line 198 is high (minor selected) and the gate 612 is enabled at other times. The lines 198 and 618 are connected in the same manner to all of the other circuits of the gating unit 608, and so there is a shift in the connections between the lines 164 and 606, depending on the state of the line 198**. This shift enables the third generator to produce the minor third, when desired, without affecting the generators for the other components of the selected chord.

The ROM units 600–604 produce outputs on their various output lines, in response to energization of one of the input lines 606, in combination which are dependent on the information stored in the ROM. This information is representative of divisor signals, as described above.

A shift register shown as having three sections 621–623 is shown in FIG. 11, and the individual stages of the shift register are loaded periodically in response to the outputs of the ROM units 600–604. The fifth and ninth stages of the shift register are connected to two inputs of an exclusive OR gate 626, and the output of the exclusive OR gate is applied to the section 621 to set the first stage to a binary "1." Clock pulses applied to all three sections over a line 104 causes the state of the shift register to change its functions in the manner of a counter, with the voltage levels on the output lines of the various stages being indicative of the state of the counter. Eventually a state will be reached in which the first eight stages are all in the zero state, and the output lines of these stages are all connected to inputs of an OR gate 628. The output of the OR gate 628 changes, in response to this condition, and energizes the L (load) inputs of all of the three sections, to again load the shift register from the ROM and repeat the operation. The load pulse is also passed to the output line 188. It is apparent that the time between loading and reloading depends on the quantity loaded into the shift register. Thus, the output pulse repetition rate on the line 188 is determined by the states of the output lines of the ROM, which cause the setting of the shift register.

Power-On Reset

The power-on reset function is accomplished by a unit (not shown) which produces a pulse in response to power being initially applied to the apparatus. This pulse is connected to all of the various lines labeled POR in FIG. 4, for resetting the state of various flip-flops to an initial condition, so that the initial state of the apparatus is always the same when first turned on.

Miscellaneous

Instead of using pulses produced by the rhythm unit 66 for triggering operation of the strum and walking bass operations, these operations may be initated by player-produced pulses, instead. Also the free running oscillator 348 used for the strum clock generator may be operated by an external source of pulses in the same mode as described for the clock generator 406 for the arpeggio function; similarly the arpeggio clock generator may be operated in a free running fashion by connecting a frequency-determining RC circuit to the terminal 408.

The several tone signal generators 44–48 are all identical in terms of the frequencies produced in response to signals applied to one of the input lines, although, of course, the same input of different generators is connected to different input lines 164, so that they can produce different outputs in response to energization of a single line 164. The frequencies produced by each are approximately as follows:

| | | | |
|---|---|---|---|
| A | 880 Hz | D# | 622 Hz |
| A# | 933 Hz | E | 660 Hz |

-continued

| | | | |
|---|---|---|---|
| B | 988 Hz | F | 698 Hz |
| C | 1046 Hz | F# | 740 Hz |
| C# | 1108 Hz | G | 784 Hz |
| D | 1180 Hz | G# | 831 Hz |

Summary

From the foregoing description it will be appreciated that the present invention provides, on a single semiconducting chip, a complete structure which performs a multitude of functions in association with the operation of an electronic musical instrument. When the hi-low mode is selected, the apparatus produces two output signals having frequencies corresponding to the highest and lowest depressed keys within a certain area of the keyboard, so that a rhythm unit, in association with the keyers, can cause repetition and/or alternation of the two corresponding notes in the bass.

When the automatic chord mode is selected, a chord is produced in response to depression of a single key within a certain area of the keyboard, and the components of the selected chord may be provided as outputs, either only when the key is so depressed, or continually until a different key is depressed, by operating the latch switch. In the bass, either a walking bass incorporating the root, third, fifth, sixth (and seventh) of the selected chord is produced, or the root and fifth notes of the selected chord are produced, so that they may be keyed in the same manner as the two bass notes in the highlow mode.

The strum operation may be selected in one of two separate octave ranges, and the arpeggio operation may be selected incorporating the root, third and fifth of the selected chord in three successive octaves.

The selected chord may be minored if desired, and a seventh added to it, if desired. When the latch function is selected, the chord, including its minor and seventh features, if any, continues to sound as long as the chord is selected. The minor and seventh may be removed by depressing a higher (or more rightward) key for another chord without releasing the key which selected the previous chord, even when the latch function is selected.

In addition, there is provided a serial output train of pulses incorporating, in the hi-low mode, pulses for all of the operated keys of the keyboard outside a selected range of chord-selecting keys and, within the selected range of keys, the highest operated key together with pulses for the third, fifth and seventh (if desired) of the selected chord.

From the foregoing, the apparatus of the present invention has been described in such detail as to enable others skilled in the art to make and use the same, without departing from the essential features of novelty involved, which are intended to be defined and secured by the appended claims. It will be appreciated that certain modifications and additions may be made if desired. For example, it may be desirable to cause the apparatus to automatically alternate between the high and low strum pitches. This can be accomplished readily by employing a flip-flop having its output connected to a relay or the like, for closing a pair of contacts when the flip-flop is set, such contacts being connected in parallel with the contacts of the switch responsible for setting the P flip-flop 250. The flip-flop is alternately set and reset with pulses received from the rhythm unit 66, so that for alternate intervals the switch operated by the flip-flop is open and closed, controlling the strum function to produce the two pitch levels alternately. Other modifications will occur to those skilled in the art.

What is claimed is:

1. In an electronic musical instrument having a plurality of function selecting switches, a keyboard, tone signal generating means responsive to operation of the keyboard keys, and an output system responsive to said tone signal generating means, the combination comprising: signal producing means responsive to the operation of one or more keys of said keyboard for producing a digitally coded signal indicative of a selected chord; said tone generating means including N separate tone signal generators, one for each note of an N note chord; first connector means for applying at least a selected portion of said coded signal to each of said tone signal generators, each of said tone signal generators producing an output tone signal, in response to the signal applied thereto, corresponding to a different note of said selected chord; and second connector means, connected to said function switches and to said output system and responsive at least in part to said function switches, for selectively applying the output tone signals from said tone signal generators to said output system.

2. Apparatus according to claim 1, including multiplex means comprising a plurality of single-pole switches associated with the keys of said keyboard, one pole of each of said switches being connected to one of a first set of conductors, the second pole of each of said switches being connected to one of a second set of conductors, said first set of conductors connecting in common the first terminal of all said switches associated with keys of the same note name, said second set of conductors connecting in common a second terminal of all of said switches associated with keys of the same octave group, means for repetitively scanning said first set of conductors at a first rate, means connected with said second set of conductors for scanning said second set of conductors at a second rate which permits the complete scan of all of said first set of conductors while each individual conductor of said second set is being scanned, and means for connecting said second set of conductors to a common output terminal, whereby there is produced at said common output terminal a train of pulses corresponding to operated ones of said switches, occurring in time encoded position in accordance with the operated switches.

3. Apparatus according to claim 2, wherein the scanning means for said first set of conductors incorporates counting means for manifesting a representation of the note name of the key being scanned at any instant, and means for connecting said storage means to said counting means, for storing a representation of said note name in response to a pulse received from one of a group of predetermined keys.

4. Apparatus according to claim 2, including pulse adding means connected to said common output terminal, for adding pulses to said pulse train corresponding to unoperated keys which are related to the tone signals produced by said tone signal generators.

5. Apparatus according to claim 1, wherein said signal producing means include means for producing a series of separate pulses, one for each operated key of a predetermined group of keys, means responsive to a first of said pulses for initiating a window period, means responsive to another of said pulses for terminating said window period, and means for manifesting a window signal during said window period.

6. Apparatus according to claim 5, including means responsive to said window signal and to one of said pulses occurring during said window period for producing a gating pulse, and means for connecting said gating pulse to said storage means, manifesting means for manifesting a representation of the note name of the key represented by said gating pulse and means for connecting said manifesting means to said storage means to cause said storage means to store said representation at the time of said gating pulse.

7. Apparatus according to claim 6, including means for identifying the first of said pulses occurring during a window period and for producing said gating pulse in response thereto.

8. Apparatus according to claim 6, including means for identifying every one of said pulses occurring during said window period and producing said gating pulse in response thereto, whereby said storage means is caused to store the representation of the key corresponding to the last pulse received within said window period.

9. Apparatus according to claim 1, including manifesting means responsive to said signal producing means for manifesting a representation of the note name of an operated key of said keyboard, storage means connected to said manifesting means and to said signal generating means and operative to store the representation manifested by said manifesting means, means connecting all of said tone signal generators to said storage means, said tone signal generators being responsive to the output of said storage means for generating tone signals having frequencies bearing a predetermined relation to the note name representation stored in said storage means.

10. Apparatus according to claim 9, wherein each of said generators comprises a programmable frequency synthesizer having a read only memory, addressing means for said read only memory, and a programmable divider connected to said read only memory, means for connecting said storage means to said addressing means for addressing a section of said read only memory corresponding to the representation stored in said storage means, said divider being programmed by signals produced by said read only memory in accordance with signals supplied to said addressing means, and means for connecting said programmable divider to a source of clock pulses, whereby said programmable divider produces an output signal having a frequency which is a quotient of the frequency of said clock pulses.

11. Apparatus according to claim 9, including a decoder connected to said storage means for producing an individual signal on one of a plurality of output lines corresponding to the note name, the representation of which is stored in said storage means, each of said generators having a plurality of input terminals connected in common to said plurality of output lines, and each of said generators being adapted to respond to a single energized one of said plurality of output lines to produce a tone signal having an individual frequency.

12. Apparatus according to claim 1, including a plurality of divider units, one for each of said tone signal generators, said divider units being connected between each of said tone signal generators and said output system, manifesting means for manifesting a representation of the note name of a key corresponding to a pulse of said pulse train, means for connecting said manifesting means to said storage means to cause said storage means to store said representation, and means connecting said storage means with said divider units for controlling the operation of said divider units in accordance with said representation.

13. Apparatus according to claim 1, wherein two of said generators simultaneously produce two tone signals corresponding to two different keys of the keyboard which are simultaneously depressed.

14. Apparatus according to claim 1, wherein said signal producing means includes means for identifying a single operated key of said keyboard and means reponsive to said last named means for operating all of said generators.

15. Apparatus according to claim 14, wherein said last named means causes said generators to produce tone signals corresponding to the root, third and fifth of a selected chord, said tone signals each being produced by a separate one of said generators.

16. Apparatus according to claim 15, including means for causing one of said generators for producing a tone signal corresponding to the seventh of said selected chord, and means responsive to one of said function selecting switches for selectively producing an output signal containing said tone signal corresponding to the seventh of the chord.

17. Apparatus according to claim 15, including means responsive to one of said function selecting switches for selectively causing one of said generators to produce a tone signal corresponding to the minor third of said selected chord.

18. Apparatus according to claim 15, including strum means responsive to one of said function selecting switches for causing said tone signals to be produced at an output terminal successively in predetermined order.

19. Apparatus according to claim 18, including a plurality of tone signal output terminals, a plurality of gates for connecting individual ones of said generators to said output terminals when said one function selecting switch is closed, a plurality of keying signal output terminals, and means for providing pulses sequentially to said keying signal output terminals.

20. Apparatus according to claim 19, wherein said last named means comprises a clock signal generator, a plurality of gates each having an output connected to one of said keying signal output terminals, and pulse distributing means for successively applying pulses from said clock signal generator to said keying signal output terminals.

21. Apparatus according to claim 20, including bistable means, means for connecting an input pulse to said bistable means for setting said bistable means to a first state, means connecting said bistable means to said pulse distributing means for initiating operation of said pulse distributing means, and means for resetting said bistable means at the end of one cycle of pulses applied to said keying signal output terminals.

22. Apparatus according to claim 21, including means for selectively producing at one of said tone signal output terminals a tone signal corresponding to the seventh of a selected chord, and a corresponding signal at one of said keying signal output terminals, and means for resetting said bistable means following production of said corresponding signal.

23. Apparatus according to claim 21, including means for resetting said pulse distributing means with said bistable means, whereby said strum output means initiates each cycle of operation with production of a pulse at the same keying signal output terminal.

24. Apparatus according to claim 14, including a tone signal output terminal, and means for sequentially connecting individual ones of said tone signal generators to said tone signal output terminal in ascending and descending order, relative to the pitches of said tone signals which are connected to said tone signal output terminal.

25. Apparatus according to claim 24, including multiplexer means for connecting said generators one at a time to said tone signal output signal, a bistable device, means for sequencing said multiplexer means in ascending order when said bistable device is in one state and for sequencing said multiplexer means in descending order when said bistable device is in its other state, and means for alternately setting and resetting said bistable device, respectively, when the highest and lowest pitches of said tone signals are connected to said tone signal output terminal.

26. Apparatus according to claim 25, including means for selectively resetting the sequencing means for said multiplexer means to begin a new cycle of operation with the connection of a predetermined tone signal to said tone signal output terminal.

27. Apparatus according to claim 26, including means for manifesting a control signal when the identity of said single operated key is changed, and selectively operable means responsive to said control signal for resetting the sequencing means for said multiplexer.

28. Apparatus according to claim 26, including means for producing a signal in response to non-operation of one of said function selecting switches, and means responsive to said control signal for resetting the sequencing means for said multiplexer means.

29. Apparatus according to claim 24, wherein said tone signal generators produce tone signals corresponding to the root, third and fifth of a selected chord, and including first and second frequency divider stages for each of said root, third and fifth tone signals, to produce the second and fourth subharmonics of each of said tone signals, and means for connecting to said multiplexer means each of said tone signals and each of said subharmonics, whereby nine tone signals are connected to said tone signal output terminal.

30. Apparatus according to claim 1, including a storage device for each of said function selecting switches, and cyclically operable means for setting each of said storage devices for each cycle in which its respective switch is closed and resetting it for each cycle in which its respective switch is open.

31. Apparatus according to claim 30, including bistable means connected to one of said storage devices, means for setting said bistable means when said storage device is set, means for resetting said bistable means, means producing a control signal when the identity of said one operated key is changed, and means for resetting said bistable means in response to said control signal.

32. Apparatus according to claim 14, wherein one of said function selecting switches is closed for execution of a latch operation, bistable means, means for producing a control signal in response to the occurrence of said one signal and for terminating the production of said control signal if no key within a predetermined group of keys of the keyboard is operated, means connected to receive said control signal and responsive to the existence of said control signal while said latch selecting switch is closed for setting said bistable means, and means connected to said bistable means for enabling said output signals only while said bistable means is set, and means responsive to the opening of said latch-selecting switch for disabling said output signals.

33. Apparatus according to claim 1, wherein said signal producing means and said tone generating means and said first connector means are all embodied in a single integrated circuit.

34. Apparatus according to claim 1, including logic means connected to said tone signal generators for producing a plurality of output tone signals in a predetermined order, said logic means being connected to said function selecting switches for selectively producing said output tone signals in a selected one of a plurality of octaves.

35. In an electronic musical instrument having a keyboard, tone signal generating means and an output system connected to said tone signal generating means, said tone signal generating means including a plurality of tone signal generators, the combination comprising: a source of clock pulses; a programmable frequency generator for each tone signal generator, said programmable frequency generator having a coding means adapted to generate a predetermined coded output in response to each coded signal input applied thereto, and a programmable divider for each tone signal generator connected to the output of each said coding means and to said source of clock pulses for dividing the pulse repetition rate of said clock pulses in accordance with the coded output from said coding means; control means operative in response to the operation of at least selected keys of said keyboard for applying a predetermined coded input to said coding means; and connector means responsive to the output from said programmable divider for applying a selected tone signal to said output system.

36. Appartus according to claim 35, wherein said control means includes decoder means for producing one of a plurality of coded signals in response to an operated key of said keyboard, said programmable frequency generator being resonsive to said one output signal to produce a harmonic of a frequency associated with said operated key.

37. Apparatus according to claim 36, wherein said connector means includes a plurality of cascaded frequency divider stages, and selecting means responsive to operation of a key of said keyboard for selecting the number of stages in said plurality.

38. Apparatus according to claim 37, including means connected to said selecting means for controlling said selecting means in accordance with the signals supplied to said coding means.

39. Apparatus according to claim 37, including means responsive to the octave location of the operated key of the keyboard for controlling said selecting means.

40. Apparatus claimed in claim 35, wherein the coding means of each of said tone signal generators is adapted to generate a different predetermined coded output in response to a given coded input applied thereto, and wherein said control means is operative to apply the same predetermined input to the coding means of each of said tone signal generators in response to the operation of a selected key.

41. Apparatus according to claim 40, wherein said operated key of the keyboard is a chord key; said control means including decoder means for producing a coded signal representative of the root note of the chord corresponding to an operated key of the keyboard; a first of said tone signal generators being operative in response to said coded signal for producing a tone signal output corresponding to the selected root note; a second of said tone signal generators being operative in response to said coded signal for producing a tone signal corresponding to the third of the selected chord; and a third of said tone signal generators being operative in response to said coded signal for producing a tone signal output corresponding to the fifth of the selected chord.

42. Apparatus according to claim 41, wherein a fourth of said tone signal generators is operative in response to said coded signal for generating a tone signal output corresponding to the sixth of the selected chord.

43. Apparatus according to claim 41, wherein a fourth of said tone signal generators is operative in response to said coded signal for generating a tone signal output corresponding to the seventh of the selected chord.

44. Apparatus according to claim 41, including means for providing an additional input to the coding means for the tone signal generator producing the tone signal corresponding to the third of the selected chord, said coding means generating a first output when no signal is applied to said additional input and another coded output when a signal is applied to said coded input; said programmable divider for the tone signal generator producing the tone signal corresponding to the third of the selected chord being operable responsive to one of said coded outputs for producing an output corresponding to the major third of the selected chord and responsive to the other of said coded outputs for producing an output representative of the minor third of the selected chord.

45. Apparatus according to claim 35, including means for providing an additional input to said coding means, said coding means generating a first output to said programmable divider when a signal is not present on said additional input and generating a second output to said programmable divider when a signal is present on said additional input.

46. Apparatus according to claim 35, wherein said control means includes gating means operative for applying either a first predetermined coded input to the coding means or a second predetermined coded input to said coding means, said first and second predetermined coded inputs being generated in response to the operation of different keys of said keyboard; and means controlling said gating means to apply one or the other of said predetermined inputs to the coding means.

47. Apparatus according to claim 35, wherein said coding means comprises a read only memory.

48. In an electronic musical instrument having a keyboard with playing keys, tone signal generating means and an output system connected to said tone generating means, the combination comprising manifesting means for manifesting a representation of an operated playing key of said keyboard, said tone signal generating means being responsive to said manifesting means for producing a plurality of tone signals at separate outputs, a plurality of separate strings of cascaded frequency divider stages interconnected between each of said outputs and said output system, and control means responsive to said manifesting means for selecting the number of stages in each said string.

49. Apparatus according to claim 48, wherein said manifesting means produces a control signal representative of the note name of said operated key, and said control means is responsive to said control signal.

50. In an electronic musical instrument having a keyboard with playing keys, tone signal generating means and an output system connected to said tone signal generating means, multiplexer means for developing one note-indicating signal in response to operation of each one of a predetermined group of said playing keys, and signal producing means responsive to said note-indicating signal for successively producing a plurality of additional note-indicating signals, said additional note-indicating signals indicating notes which are components of a selected chord, the root of which is identified by said one note-indicating signal, and pulse producing means for producing a first pulse in response to said one note-indicating signal, said multiplexer means comprising means responsive to said first pulse for producing further note-indicating signals corresponding to a plurality of keys of said keyboard having the same note name, and means for supplying at an output terminal only one of said further note-indicating signals for each component of said selected chord.

51. In an electronic musical instrument having a keyboard with playing keys, tone signal generating means and an output system connected to said tone signal generating means, means for developing one note-indicating signal in response to operation of each one of a predetermined group of said playing keys, and signal producing means responsive to said note-indicating signal and having a single output terminal for producing a plurality of additional note-indicating signals, said additional note-indicating signals indicating notes which are components of a selected chord, the root of which is identified by said one note-indicating signal, each of said note-indicating signals being produced at said single output terminal at a predetermined time representative of an associated playing key, said signal producing means including a plurality of delay means for delaying one note-indicating signal by different time intervals, and for producing said additional note-indicating signals at the outputs of said delay means.

52. Apparatus according to claim 50, wherein said developing means produces a note-indicating signal for every operated one of said predetermined groups of keys, and means for producing all of said note-indicating signals at a single output terminal.

53. Apparatus according to claim 51, wherein said plurality of delay means are connected in cascade.

54. An electronic musical instrument having a keyboard, tone signal generating means and an output system connected to said tone signal generating means, said tone signal generating means including coding means connected with said keyboard for producing a coded signal in response to operation of the keys of said keyboard, and a digital programmable generator responsive to said coding means for generating a tone signal corresponding to the third component of a chord, the root of which is identified by operation of a key of said keyboard, and selectively operable means connected to said programmable frequency generator for causing said generator to selectively generate the major or minor third of said chord.

55. Apparatus according to claim 54, wherein said coding means is connected with said programmable frequency generator by a plurality of control lines, and means responsive to operation of said selectively operable means for altering a signal on one of said control lines.

56. In an electronic musical instrument having a plurality of function selecting switches, a keyboard, tone signal generating means responsive to operation of the keyboard keys, and an output system connected to said tone signal generating means, the combination comprising: multiplex means connected with said keyboard for producing, in repetitive cycles, a train of time encoded pulses at pulse times within each said cycle responsive to operation of keys of said keyboard; window means connected with said multiplex means for identifying a window period defined by a predetermined range of said pulse times, during each said cycle; storage means connected with said multiplex means and with said window means for storing an indication that one of said keys has been operated, said storage means manifesting an output signal indicative of said key; a plurality of tone signal generators connected with said storage means and responsive thereto for simultaneously producing a plurality of tone signals each having a predetermined relationship to the operated key; a plurality of gates connected to receive said tone signals from said tone signal generators and for selectively passing said tone signals to said output system; and logic means conneced with said gate means and with at least one of said function selecting switches, for selectively enabling certain ones of said gates in response to operation of said one function selecting switch.

57. In an electronic musical instrument having a keyboard with playing keys, tone signal generating means and an output system connected to said tone signal generating means, means for developing a note-indicating signal in response to operation of each one of a predetermined group of said playing keys, and signal producing means responsive to said note-indicating signal for producing a plurality of additional note-indicating signals, said additional note-indicating signals indicating notes which are components of a selected chord, the root of which is identified by said one note-indicating signal, and pulse producing means for producing a first pulse in response to said one note-indicating signal, said developing means comprising means responsive to said first pulse for producing further note-indicating signals corresponding to a plurality of keys of said keyboard having the same note name, and means for supplying at an output terminal only one of said further note-indicating signals for each component of said selected chord.

* * * * *